US011083351B2

(12) United States Patent
Mallon

(10) Patent No.: US 11,083,351 B2
(45) Date of Patent: Aug. 10, 2021

(54) ACCESSORY FOR USE WITH VACUUM CLEANERS

(71) Applicant: TYROC INDUSTRIES LIMITED, Belfast (GB)

(72) Inventor: Matthew Damian Mallon, Belfast (GB)

(73) Assignee: Tyroc Industries Limited, Belfast (GB)

( * ) Notice: Subject to any disclaimer, the term of this patent is extended or adjusted under 35 U.S.C. 154(b) by 304 days.

(21) Appl. No.: 16/080,180

(22) PCT Filed: Feb. 27, 2017

(86) PCT No.: PCT/EP2017/054533
§ 371 (c)(1),
(2) Date: Aug. 27, 2018

(87) PCT Pub. No.: WO2017/144729
PCT Pub. Date: Aug. 31, 2017

(65) Prior Publication Data

US 2019/0053676 A1 Feb. 21, 2019

(30) Foreign Application Priority Data

Feb. 26, 2016 (GB) ..... 1603417

(51) Int. Cl.
*A47L 5/38* (2006.01)
*A47L 7/00* (2006.01)
(Continued)

(52) U.S. Cl.
CPC ..... *A47L 5/38* (2013.01); *A47L 5/225* (2013.01); *A47L 7/0004* (2013.01);
(Continued)

(58) Field of Classification Search
CPC ..... A47L 11/4016; A47L 5/225; A47L 5/38; A47L 7/0004; A47L 7/0009;
(Continued)

(56) References Cited

U.S. PATENT DOCUMENTS 2,617,138 A * 11/1952 Brown, Sr. ..... A47L 7/0014 15/321
3,705,437 A * 12/1972 Rukavina, Jr. ..... A47L 5/38 15/302
(Continued)

FOREIGN PATENT DOCUMENTS

CA 2174904 10/1997
EP 0730897 9/1996
(Continued)

OTHER PUBLICATIONS

English Abstract of EP0730897.
(Continued)

*Primary Examiner* — Marc Carlson
(74) *Attorney, Agent, or Firm* — Preston Smirman; Smirman IP Law, PLLC

(57) ABSTRACT

The present invention provides an accessory 20 for use with, and adaptable to be releasably connected to, a vacuum cleaner 1. The accessory 20 comprises a vacuum intake head 21 having a chamber 21*a* arranged such that when the accessory 20 is connected to the vacuum cleaner 1, the chamber 21*a* is in fluid communication with the vacuum cleaner 1 and adaptable to receive air and liquid from and around the surface to be cleaned. The accessory 20 further comprises a filtration device 40 adaptable to separate the liquid from the air such that substantially no liquid returns to the vacuum cleaner 1. The accessory 20 can be used with both portable and central vacuum cleaners 1.

35 Claims, 10 Drawing Sheets

(51) Int. Cl.

| | |
|---|---|
| ***A47L 9/12*** | (2006.01) |
| ***A47L 9/32*** | (2006.01) |
| ***A47L 5/22*** | (2006.01) |
| ***A47L 9/18*** | (2006.01) |
| ***A47L 11/40*** | (2006.01) |
| ***A47L 9/10*** | (2006.01) |

(52) U.S. Cl.
CPC ..... *A47L 7/0009* (2013.01); *A47L 7/0014* (2013.01); *A47L 7/0019* (2013.01); *A47L 7/0023* (2013.01); *A47L 7/0028* (2013.01); *A47L 9/10* (2013.01); *A47L 9/122* (2013.01); *A47L 9/18* (2013.01); *A47L 9/32* (2013.01); *A47L 11/4016* (2013.01)

(58) Field of Classification Search
CPC .... A47L 7/0014; A47L 7/0019; A47L 7/0023; A47L 7/0028; A47L 9/10; A47L 9/122; A47L 9/18; A47L 9/32
See application file for complete search history.

(56) References Cited

U.S. PATENT DOCUMENTS

| | | | | |
|---|---|---|---|---|
| 4,675,936 | A * | 6/1987 | Rawlins | A47L 7/0028 15/353 |
| 5,263,224 | A * | 11/1993 | Lovelady | A47L 7/0009 15/322 |
| 5,377,383 | A * | 1/1995 | Christensen | A47L 7/0009 15/344 |
| 6,324,723 | B1 * | 12/2001 | Dodson | A47L 7/0009 15/347 |
| 8,230,550 | B2 * | 7/2012 | Krebs | A47L 7/0038 15/344 |
| 9,186,028 | B2 * | 11/2015 | White | A47L 7/0038 |
| 2015/0297048 | A1 * | 10/2015 | Eiichi | A47L 5/225 15/246.3 |
| 2018/0168419 | A1 * | 6/2018 | Johnson | A47L 11/34 |
| 2018/0333736 | A1 * | 11/2018 | Krebs | B05B 17/0684 |
| 2019/0053676 | A1 * | 2/2019 | Mallon | A47L 7/0023 |

FOREIGN PATENT DOCUMENTS

| | | | | |
|---|---|---|---|---|
| JP | H10179455 | | 7/1998 | |
| JP | 3278659 | B2 * | 4/2002 | |
| JP | 2008049102 | | 3/2008 | |
| JP | 2008049102 | A * | 3/2008 | |
| WO | 1994008501 | | 4/1994 | |
| WO | 1994008502 | | 4/1994 | |
| WO | WO-9408501 | A1 * | 4/1994 | A47L 7/0019 |
| WO | WO-9408502 | A1 * | 4/1994 | A47L 7/0042 |

OTHER PUBLICATIONS

English Abstract of JP2008049102.
English Abstract of JPH10179455.
International Search Report dated Jun. 27, 2017.
Written Opinion of the International Searching Authority dated Jun. 27, 2017.
International Preliminary Report on Patentability dated Aug. 28, 2018.

* cited by examiner

ACCESSORY FOR USE WITH VACUUM CLEANERS

CROSS-REFERENCE TO RELATED APPLICATION

The instant application is a national phase of PCT International Application No. PCT/EP2017/054533 filed Feb. 27, 2017, and claims priority to GB Patent Application Serial No. 1603417.5 filed Feb. 26, 2016, the entire specifications of both of which are expressly incorporated herein by reference.

The present invention relates to accessories for vacuum cleaners, and in particular to accessories for use with central vacuum cleaners, also known as built-in or ducted vacuum cleaners.

Vacuum cleaners can be classed into two basic types: portable vacuum cleaners and central vacuum cleaners. In a portable vacuum cleaner, the components of the cleaner such as the vacuum source, nozzle and waste compartment are physically moved about by the user during the cleaning process, and are typically mounted on wheels for this purpose. In contrast, central vacuum cleaners have a central vacuum source installed into a building at a permanent or semi-permanent stationary location (in residential settings this will often be the garage or utility room). A network of pipes runs throughout the building to provide a number of strategically located inlet ports. A user can connect an accessory such as a hose to an inlet port in order to vacuum the building. Central vacuum cleaners can use more powerful vacuum sources than portable vacuum cleaners as the vacuum source does not have to be carried around by the user during the vacuuming. In addition, unlike portable vacuum cleaners, central vacuum cleaners do not recirculate exhaust air into the space being cleaned and thus avoid the issue of recirculating allergens and unpleasant odours.

Most existing portable and central vacuum cleaner systems are limited in that they only have a dry vacuum cleaning function. The vacuum cleaner is generally only adapted for vacuuming dry surfaces and has a simple accessory for performing the cleaning such as a simple hose having a nozzle and, optionally, one or more brushes. A user will not be able to vacuum a wet surface (e.g. after soiled liquid has been spilt on the surface), and will instead have to wait for the surface to dry before they can use the vacuum system to perform a dry vacuum cleaning. If the surface has not sufficiently dried, then liquid can be sucked up into the vacuum pump causing damage to the vacuum cleaner. Moreover, if a user desires to perform a wet cleaning of a surface then they will have to use a separate device, such as a spray hose connected to a water outlet, increasing the cleaning time and the burden on the user.

The existing systems are unsatisfactory as they require complete replacement or modification of the vacuum cleaner in order to provide the liquid filtration function. This is especially problematic in central vacuum cleaning systems as the existing, installed, central vacuum cleaners are relatively expensive and permanent devices which the user does not expect to have to modify/replace. Furthermore, the centrifugal fan arrangement is heavy and requires a large power source.

It is an object of the present invention to obviate or mitigate the problem of requiring modification/replacement of the vacuum cleaner in order to provide both dry vacuum cleaning and wet vacuum cleaning operations.

It is a further object of the present invention to obviate or mitigate the problem of the limited applications of central vacuum cleaners and provide central vacuum cleaner systems that can be utilized in both dry vacuum cleaning and wet vacuum cleaning operations.

It is a further object of the present invention to provide a central vacuum cleaner that can be utilized in both dry vacuum cleaning and wet vacuum cleaning operations which requires minimal modification to an already installed central vacuum system.

It is a further object of the present invention to obviate or mitigate the problem of vacuum cleaning wet or damp surfaces using a central vacuum cleaner.

Accordingly, the present invention provides an accessory for use with a vacuum cleaner, the accessory being adaptable to releasably connect to the vacuum cleaner, the accessory comprising:

a vacuum intake head having a chamber arranged such that when the accessory is connected to the vacuum cleaner, the chamber is in fluid communication with the vacuum cleaner and adaptable to receive air and liquid from and around the surface to be cleaned; and filtration means adaptable to separate the liquid from the air such that substantially no liquid returns to the vacuum cleaner.

Advantageously, the present invention provides an accessory for a vacuum cleaner that can be used to perform both a dry vacuum cleaning and a wet vacuum cleaning operation. In particular, the accessory can operate in a traditional manner to suck dirt, dust and other contaminants from the surface to be cleaned. In addition, the accessory can suck up liquid on the surface to be cleaned, such as soiled liquid which is contaminated with dirt, dust and other contaminants and separate the liquid from the air flow such that the liquid does not return to the vacuum cleaner where it could damage the vacuum pump. The filtration means is part of the releasably connectable accessory, rather than part of the vacuum cleaner itself. This means that the accessory of the present invention is useable with vacuum cleaners for wet cleaning operations even if the vacuum cleaners do not have liquid filtration means. As a result, the present invention does not require modification to the vacuum cleaner in order to provide the wet cleaning operation as the wet cleaning and filtering operations are performed by the accessory, with the vacuum cleaner just performing the conventional role of providing a vacuum source.

Preferably, the accessory being for use with a central vacuum cleaner, the accessory being adaptable to releasably connect to the central vacuum cleaner. Advantageously, the present invention provides dry cleaning and wet cleaning operations for central vacuum cleaners, without requiring any modification to the central vacuum cleaners themselves, which could be expensive and undesirable.

Ideally, the filtration means being disposed within the accessory and in the fluid path between the chamber of the vacuum intake head and the vacuum cleaner.

Preferably, the filtration means comprising a waste fluid storage means having an inlet in fluid communication with the chamber of the vacuum intake head and an outlet in fluid communication with the vacuum cleaner.

Ideally, the outlet of the waste fluid storage means is restricted in size to limit the amount of liquid that escapes from the outlet. Advantageously, the outlet of the waste fluid storage means restricts the water flow from leaving the waste fluid storage means, while still allowing air to escape.

In one arrangement, the filtration means being an active filtration means.

Ideally, the active filtration means comprising a powered centrifugal fan.

More preferably, the filtration means being a passive filtration means.

Advantageously, the passive filtration means does not require any power source (other than the vacuum provided by the vacuum cleaner) to separate the liquid from the air stream, and thus can be incorporated into the accessory of the vacuum cleaner without substantially increasing the weight or power consumption of the accessory.

Preferably, the passive filtration means comprising a waste fluid storage means having an inlet in fluid communication with the chamber of the vacuum intake head and an outlet in fluid communication with the vacuum cleaner.

Ideally, the outlet of the waste fluid storage means is restricted in size to limit the amount of liquid that escapes from the outlet. Advantageously, the outlet of the waste fluid storage means restricts the water flow from leaving the waste fluid storage means, while still allowing air to escape.

Preferably, the outlet of the waste fluid storage means is a slit or slot.

In a first arrangement, the passive filtration means comprising: a waste fluid storage means having an inlet in fluid communication with the chamber of the vacuum intake head and an outlet; a filter in fluid communication with the outlet of the waste fluid storage means; and an outlet conduit extending from the filter and adaptable to be releasably connected to the vacuum cleaner, the filter adaptable to trap contaminated liquid that has escaped from the outlet of the waste fluid storage means and prevent it entering the outlet conduit.

Advantageously, the filter is adaptable to trap liquid and prevent it from entering the outlet conduit, and thereby prevent the liquid from reaching the vacuum cleaner.

Ideally in the first arrangement, the passive filtration means comprising a plurality of filters arranged in series between the outlet of the waste fluid storage means and the outlet conduit.

Preferably in the first arrangement, the plurality of filters have different grades of permeability such that filters closer to the outlet of the waste fluid storage means are more permeable than filters closer to the outlet conduit.

Ideally in the first arrangement, the permeability of the plurality of filters decreases consecutively from the outlet of the waste fluid storage means to the outlet conduit.

Most preferably in the first arrangement, the size of the outlet of the waste fluid storage means is restricted to limit the amount of liquid that escapes from the waste fluid storage means.

Advantageously, the outlet of the waste fluid storage means restricts the water flow from leaving the waste fluid storage means, while still allowing air to escape. The filter provided downstream of the waste fluid storage means is able to trap any contaminated work fluid that does manage to exit the waste fluid storage means and prevent it from reaching the vacuum cleaner.

Ideally in the first arrangement, the outlet of the waste fluid storage means is a slit or slot.

Preferably in the first arrangement, the waste fluid storage means comprising a plurality of outlets, the passive filtration means comprising a corresponding number of filters and outlet conduits associated with the plurality of outlets.

Ideally in the first arrangement, the passive filtration means further comprises an inlet conduit extending between the chamber of the vacuum intake head and the inlet of the waste fluid storage means.

Preferably in the first arrangement, the waste fluid storage means comprises a plurality of inlets and a corresponding number of inlet conduits extending between the chamber of the vacuum intake head and the inlet of the waste fluid storage means.

Preferably in the first arrangement, the filtration means further comprising a filter enclosure.

Ideally in the first arrangement, the filter is removable from the filter enclosure. Advantageously, this enables the filter to be cleaned/replaced.

Ideally in the first arrangement, the filter enclosure comprising a drain in fluid communication with the waste fluid storage means. Advantageously, the drain enables liquid in the enclosure (i.e. liquid that was trapped by the filters) to return to the waste fluid storage means.

In a second arrangement, the passive filtration means comprising a waste fluid storage means having an inlet in fluid communication with the chamber of the vacuum intake head and an outlet; and an outlet conduit extending from the outlet of the waste fluid storage means and adaptable to be releasably connected to the vacuum cleaner, the outlet conduit having at least one twist or turn arranged such that liquid travelling in the outlet conduit loses kinetic energy due to collisions with the walls of the outlet conduit and returns to the waste fluid storage means.

Advantageously, the at least one twist or turn in the outlet conduit causes the liquid molecules to collide with the walls of the outlet conduit, causing them to lose energy and return to the waste fluid storage means due to gravity. This means that the liquid molecules do not enter the vacuum cleaner, and thus avoid the risk of damage to the vacuum pump.

Ideally in the second arrangement, the passive filtration means further comprises an inlet conduit extending between the chamber of the vacuum intake head and the inlet of the waste fluid storage means.

Preferably in the second arrangement, the waste fluid storage means comprises a plurality of inlets and a corresponding number of inlet conduits extending between the chamber of the vacuum intake head and the inlet of the waste fluid storage means.

Ideally in the second arrangement, the waste fluid storage means comprises a plurality of outlets and a corresponding number of outlet conduits extending from the outlet of the waste fluid storage means.

Preferably, each of the outlet conduits having at least one twist or turn arranged such that liquid travelling in the outlet conduits loses kinetic energy due to collisions with the walls of the outlet conduits and returns to the waste fluid storage means.

Ideally, the accessory further comprising cut-off valve means for cutting-off the fluid communication between the waste fluid storage means and the vacuum cleaner.

Preferably, the accessory further comprising an elongate body extending upright from the vacuum intake head.

Ideally, the cut-off valve means being disposed within the elongate body of the accessory.

Preferably, the passive filtration means is housed in the elongate body of the accessory.

Ideally, the cut-off valve means being adaptable to cut-off fluid communication between the waste fluid storage means and the vacuum cleaner in response to the longitudinal axis of the elongate body substantially being aligned with the horizontal. Advantageously, the cut-off valve means can cut-off the fluid communication when the elongate body is dropped or placed on the ground. Therefore, any waste fluid that leaks out of the waste fluid storage means in this situation will not return to the vacuum cleaner.

Preferably, the cut-off valve means being adaptable to cut-off fluid communication between the waste fluid storage means and the vacuum cleaner in response to the longitudinal axis of the elongate body being over 45° away from the vertical.

Ideally, the cut-off valve means being adaptable to cut-off fluid communication between the waste fluid storage means and the vacuum cleaner in response to the longitudinal axis of the elongate body being over 60° away from the vertical.

Preferably, the cut-off valve means being adaptable allow fluid communication between the waste fluid storage means and the vacuum cleaner when the longitudinal axis of the elongate body is less than 45° away from the vertical.

Ideally, the cut-off valve means being adaptable allow fluid communication between the waste fluid storage means and the vacuum cleaner when the longitudinal axis of the elongate body is less than 60° away from the vertical.

In one preferred arrangement, the cut-off valve means comprising a flap disposed within the fluid path between the waste fluid storage means and the vacuum cleaner, the flap being adaptable to transition between an open position allowing fluid communication between the waste fluid storage means and the vacuum cleaner, and a closed position cutting-off fluid communication between the waste fluid storage means and the vacuum cleaner.

Ideally, the flap being sized to remain in the open position when the longitudinal axis of the elongate body is less than 45°, or more preferably less than 60° away from the vertical.

Ideally, the flap being sized to transition to the closed position in response to the longitudinal axis of the elongate body being more than 45°, or more preferably more than 60° away from the vertical.

In another preferred arrangement, the cut-off valve means comprising a retaining means disposed within the elongate body and a ball adaptable to be releasably held in the retaining means, the ball being sized to have a diameter greater to or substantially equal to the width of at least part of the fluid path between the waste fluid storage means and the vacuum cleaner upstream of the retaining means.

Ideally, the retaining means comprising a cage for retaining the ball and a ramp extending into the fluid path between the waste fluid storage means and the vacuum cleaner, the ramp being shaped to prevent the ball for leaving the cage until the longitudinal axis of the elongate body moves beyond a threshold angle away from the vertical.

Ideally, the ramp being further shaped to guide the ball back to the cage when the longitudinal axis of the elongate body returns to an angle less than the threshold angle away from the vertical.

Preferably, the ramp comprises one or more perforations to allow fluid flow through the ramp. Advantageously, this means that the ramp does not overly affect the fluid communication during normal use.

Ideally, the fluid path comprises a tapered section proximal to an outlet of the accessory, the ball being sized to have a diameter greater to or substantially equal to the minimum width of the tapered section of the fluid path.

Preferably, the retaining means being adaptable to retain the ball when the longitudinal axis of the elongate body is less than 45°, or more preferably less than 60° away from the vertical.

Ideally, the retaining means being adaptable to release the ball into the fluid path in response to the longitudinal axis of the elongate body being more than 45°, or more preferably more than 60° away from the vertical, the ball being adaptable to block the fluid path at a position where the width of the fluid path is substantially equal to or narrower than the width of the ball.

In another preferred arrangement, the cut-off valve means being adaptable to cut-off fluid communication between the waste fluid storage means and the vacuum cleaner in response to liquid escaping from the filtration means.

Preferably, the cut-off valve means comprising a sensing means for detecting liquid escaping from the filtration means.

Ideally, the cut-off valve means comprising a flap disposed within the fluid path between the filtration means and the vacuum cleaner, the flap being moveable between an open position allowing fluid communication between the filtration means and the vacuum cleaner, and a closed position cutting-off fluid communication between the filtration means and the vacuum cleaner; and drive means adaptable to move the flap to the closed position in response to the sensing means detecting liquid escaping from the filtration means.

Preferably, the sensing means being located upstream of the flap.

Ideally, the waste fluid storage means comprising a waste fluid storage container.

Ideally, the waste fluid storage container comprising an inlet in fluid communication with the chamber of the vacuum intake head and an outlet, the outlet of the waste fluid storage container being in fluid communication with the vacuum cleaner.

Preferably, the outlet of the waste fluid storage container being locatable on an upper portion of the waste fluid storage container. Advantageously, this means that during normal use, the outlet of the waste fluid storage container will remain above the water line in the waste fluid storage tank.

Ideally, the outlet of the waste fluid storage container being locatable on a top surface of the waste fluid storage container.

Preferably, the waste fluid storage container being releasably attachable to the accessory. Advantageously, the waste fluid storage container can be removed from the accessory so that the waste fluid storage container can be emptied and cleaned, if necessary.

Ideally, the waste fluid storage container further comprising a carrying handle.

Alternatively, the waste fluid storage container being integrally formed with the accessory/elongate body.

Ideally, the elongate body and the waste fluid storage container are manufactured as a one piece/homogeneous unit.

Preferably, the waste fluid storage container having drainage means to allow the waste fluid storage container to be emptied. Such as into a sink or toilet.

Ideally, the waste fluid storage container comprising a push button on an outside surface thereof, actuation of the push button opens the drainage means to allow the waste fluid storage container to be emptied.

Preferably, the waste fluid storage container further comprising means for closing the outlet of the waste fluid storage container in response to the volume of liquid in the waste fluid storage container exceeding a threshold value. Advantageously, this seals off the outlet if the waste fluid storage container is overfilled, preventing liquid from escaping from the outlet.

Ideally, the means for closing the outlet comprising a ballcock valve adaptable to rise with the liquid level in the waste fluid storage container and block the outlet of the waste fluid storage container once the volume of liquid in the waste fluid storage container exceeds a threshold value.

Alternatively, the means for closing the outlet comprising a cage attached to an inside surface of the waste fluid storage container and enclosing the outlet; and a ball disposed within the cage, the ball being adaptable to rise with the liquid level and block the outlet of the waste fluid storage container once the volume of liquid in the waste fluid storage container excess a threshold value.

Ideally, the accessory comprising spraying means for spraying a work fluid onto a surface to be cleaned. Advantageously, the spraying means can spray a work fluid onto the surface to be cleaned to perform a wet cleaning operation.

Preferably, the spraying means being adaptable to spray work fluid directly onto the surface to be cleaned.

Ideally, the surface to be cleaned being the floor or ground which the vacuum intake head is positioned over.

Ideally, the spraying means comprises a work fluid storage means; a pumping means; and at least one work fluid conduit in fluid communication with the work fluid storage means, the pumping means being adaptable to pump work fluid from the work fluid storage means and through the at least one work fluid conduit.

Ideally, the at least one work fluid conduit terminating in at least one nozzle. Advantageously, the nozzle can concentrate the work fluid into a stream to be sprayed onto the surface to be cleaned.

Ideally, the stream will have a pressure in the range of 2.5 to 40 PSI.

Preferably, the stream will have a pressure in the range of 25 to 40 PSI.

Preferably, the work fluid storage means comprising an inlet, an outlet and a valve means biased to close the outlet, the valve means being adaptable to open the outlet when the work fluid storage means is positioned within the accessory.

Ideally, the work fluid conduit being adaptable to align with the outlet of the work fluid storage means in use.

Preferably, the valve means being adaptable to open the outlet when the work fluid conduit is aligned with the outlet of the work fluid storage means.

Ideally, the valve means being adaptable to close the outlet when the work fluid conduit is out of alignment with the outlet of the work fluid storage means.

Preferably, the inlet being an accessible inlet for receiving work fluid.

Advantageously, the user can fill the work fluid storage means using the accessible inlet, such as by using a water jug or kettle, and does not have to separate the work fluid storage means and take it to a water source in order to fill it.

Ideally, the accessible inlet is located on an outer side surface of the accessory.

Preferably, the work fluid storage means comprising a means for restricting access to the inlet.

Ideally, the means for restricting access to the inlet being a pivotally moveable flap. Preferably, the work fluid storage means comprising a work fluid storage container.

Ideally, the work fluid storage means being releasably attachable to the accessory. Advantageously, the work fluid storage means can be removed from the accessory to be refilled with work fluid and/or cleaned.

Preferably, the work fluid storage means further comprising a carrying handle connected to the work fluid container.

Alternatively, the work fluid storage means being formed from the same material or integrally formed with the accessory.

Advantageously, in this alternative arrangement the accessory has a simple construction requiring fewer separable components. In addition, the fixed work fluid storage means can be optimally designed to receive and retain boiling water.

Ideally, the pumping means being one of a diaphragm pump, peristaltic pump or vane pump.

More preferably, the pumping means being a compressor. Advantageously, the compressor enables the spraying means to spray boiling or nearly boiling water onto the surface to be cleaned.

Ideally, the pumping means being adaptable to intermittently spray work fluid onto the surface to be cleaned.

Preferably, the work fluid storage means comprising control means operable to selectively activate the pumping means.

In one arrangement, the control means being a manually operated switch positioned on an external surface of the accessory, the switch being operable to trigger the pumping means to spray work fluid onto the surface to be cleaned. Advantageously, by operating the switch, the user can control when work fluid is sprayed onto the surface to be cleaned.

Ideally, the accessory comprising a handle, the switch being positioned proximal to the handle. Advantageously, the switch is in a position that can easily be reached by a user during a cleaning operation.

Preferably, the switch being a trigger switch.

In another arrangement, the control means being a controller disposed within the accessory, the controller being programmable to selectively activate the pumping means to spray work fluid.

Ideally, the controller being programmable to periodically activate the pumping means to spray work fluid.

Preferably, the controller having a first operating mode for periodically activating the pumping means to spray work fluid at a first frequency, and at least one other operating mode for periodically activating the pumping means to spray work fluid at a second frequency different to the first frequency. Advantageously, the operating mode can be chosen, e.g. by a user, based on the surface to be cleaned. For example, the controller may have a "high frequency", "medium frequency" and "low frequency" operating modes which will activate the pumping means at different frequencies. The "high frequency" mode would activate the pumping means at a relatively fast rate making it suitable for cleaning excessively soiled areas but would drain the work fluid storage means of work fluid relatively quickly. The "medium frequency" and "low frequency" operating modes would operate at correspondingly slower rates making them suitable for less soiled areas and drain the work fluid storage means more slowly. A user would be able to select operating mode through use of a control panel located on an external surface of the handle.

In one arrangement, the spraying means comprising: a work fluid storage means fixedly attached to the accessory; a compressor; and at least one work fluid conduit in fluid communication with the work fluid storage means, the compressor being adaptable to pump work fluid from the work fluid storage means and through the at least one work fluid conduit. Advantageously, in this arrangement, the fixedly attached work fluid storage device can be optimally designed to receive and retain boiling water, and resist the water pressure within the work fluid storage means caused by a compressor.

Preferably, the work fluid storage means further comprising insulation means. Advantageously, the insulation means reduces the spread of heat from the work fluid storage means.

Ideally, the work fluid storage means further comprising a heating element for heating the work fluid. Advantageously, the heating element can heat or help maintain the temperature of the work fluid in the work fluid storage means.

Preferably, the heating element being a resistive heating element. Exemplary restive heating elements include metal heating elements, ceramic heating elements and positive thermal coefficient (PTC) ceramic heating element.

Most preferably, the heating element being a thermoelectric heating element.

Ideally, the chamber of the vacuum intake head is adaptable to receive air and contaminated work fluid from and around the surface to be cleaned. Here, "contaminated work fluid" means work fluid laden with dust or dirt particles or other contaminants.

Ideally, the vacuum intake head comprising a hollowing housing having at least one air intake slot in fluid communication with the chamber and at least one liquid outlet slot in fluid communication with the spraying means, the spraying means being adaptable to spray work fluid onto the surface to be cleaned through the liquid outlet slot.

Preferably, the air intake slot and liquid outlet slot being disposed in the floor of the housing.

Ideally, the air intake slot being positioned towards the leading edge/portion of the housing, the liquid outlet slot being positioned behind the air intake slot. In a typical cleaning operation, a user will sweep the vacuum intake head forwards over the surface to be cleaned. The air intake slot is positioned towards the leading edge/portion of the housing and so will come into contact with the surface to be cleaned before the work fluid sprayed out of the work fluid storage means. The suction through the air intake slot will act to suck up the loose dust, dirt and debris, but contaminants which are more rigidly adhered to the surface to be cleaned may remain despite the presence of the suction path. Beneficially, the work fluid which is sprayed onto the surface to be cleaned will help to loosen these contaminants. A user can then sweep the vacuum intake head backwards over the surface to be cleaned to suck up the wetted contaminants. Optionally, and as discussed in one or more arrangements later on, the vacuum intake head will have one or more rotatable brushes for agitating the wetted surface to be cleaned to help loosen the contaminants from the surface.

Preferably, the vacuum intake head comprising two air intake slots, a first of the air intake slots being positioned towards the leading edge/portion of the housing and a second of the air intake slots being positioned towards the rear end portion of the housing, the liquid outlet slot being disposed between the air intake slots. Advantageously, in this arrangement, the second air intake slot will suck up the contaminants loosened by the work fluid during the forward sweeping operation. Optionally, the housing comprising more than two air intake slots and/or more than one liquid outlet slots.

Preferably, the vacuum intake head comprising an internal member shaped to separate the air intake slot from the liquid outlet slot.

Preferably, the internal member being a bifurcated member comprising a first wall section and a second wall section, the chamber being defined above the upper surface of the first wall section and the upper surface of the second wall section.

Ideally, the first wall section being a generally planar wall extending from a lower front end portion of the vacuum intake head to an upper rear end portion of the vacuum intake head.

Preferably, the first wall section tapers from the lower front end portion of the vacuum intake head to the upper rear end portion of the vacuum intake head.

Ideally, the first wall section is generally arcuate.

Preferably, the second wall section generally extending from the upper rear end portion of the vacuum intake head to the lower rear end portion of the vacuum intake head.

Ideally, the hollow housing of the vacuum intake head comprising an openable flap. Advantageously, the openable flap enables an operator to access the components inside the vacuum intake head, such as for maintenance.

Ideally, at least one nozzle of the spraying means being provided in the hollow housing in fluid communication with the liquid outlet slot. Preferably, the vacuum intake head comprising at least one rotatable brush for agitating the surface to be cleaned.

Ideally, the at least one rotatable brush being disposed over the liquid outlet slot such that a portion of the at least one rotatable brush is adaptable to be in contact with the surface to be cleaned through the liquid outlet slot.

Alternatively, the housing comprising two or more liquid outlet slots, the spraying means being adaptable to spray work fluid through one of the liquid outlet slots and the at least one rotatable brush being disposed over another of the liquid outlet slots.

Preferably, the spraying means being adaptable to spray work fluid onto and around the at least one rotatable brush.

Preferably, the spraying means being adaptable to spray work fluid onto and around the at least one rotatable brush to perform a brush cleaning operation.

Ideally, the spraying means being adaptable to spray work fluid onto and around the surface to be cleaned and spray work fluid onto and around the at least one rotatable brush.

Ideally, the spraying means being adaptable to switch between spraying work fluid onto and around the surface to be cleaned and spraying work fluid onto and around the at least one rotatable brush. In this way, a user can switch between a surface/floor cleaning operation and a brush cleaning operation. Preferably, the accessory comprising control means to enable a user to switch the spraying means between spraying work fluid onto and around the surface to be cleaned and spraying work fluid onto and around the at least one rotatable brush.

Preferably, the at least one rotatable brush being rotatably connected to the housing.

Ideally, the at least one rotatable brush is detachable from the housing.

Advantageously, this means that the at least one rotatable brush can be removed from the housing and replaced. Ideally, the accessory further comprising a motor adaptable to rotate the rotatable brush. Advantageously, the rotatable brush agitates the surface to be cleaned, such as where the work fluid has already been applied by the spraying means. The work fluid gets contaminated by the dust and dirt particles on the surface to be cleaned, and is removed from the surface to be cleaned by the suction force generated by the vacuum cleaner.

Preferably, the motor adaptable to rotate the rotatable brush is locatable within the vacuum intake head.

Ideally, the vacuum intake head comprising at least one non-rotatable brush.

Preferably, the at least one rotatable brush being one of a nylon, polypropylene, horse hair, micro fibre, Tampico, or a Palmyra brush.

Ideally, the at least one non-rotatable brush being one of a nylon, polypropylene, horse hair, micro fibre, Tampico, or a Palmyra brush.

Preferably, the at least one non-rotatable brush being detachable from the housing.

Ideally, the spraying means being adaptable to spray work fluid onto and around the at least one non-rotatable brush.

Preferably, the spraying means being adaptable to spray work fluid onto and around the at least one non-rotatable brush to perform a brush cleaning operation.

Ideally, the spraying means being adaptable to spray work fluid onto and around the surface to be cleaned and spray work fluid onto and around the at least one non-rotatable brush.

Ideally, the spraying means being adaptable to switch between spraying work fluid onto and around the surface to be cleaned and spraying work fluid onto and around the at least one non-rotatable brush. Preferably, the accessory comprising control means to enable a user to switch the spraying means between spraying work fluid onto and around the surface to be cleaned and spraying work fluid onto and around the at least one non-rotatable brush.

Ideally, the accessory further comprising an elongate body, the vacuum intake head being releasably connected to the elongate body. Advantageously, this means that the vacuum intake head can be detached from the elongate body. In some arrangements, differently sized vacuum intake heads will be provided for cleaning different areas. For example, a large vacuum intake head can be provided for cleaning large open areas, while a smaller vacuum intake head can be provided for cleaning cracks, crevices, remote places or other places that are inaccessible with the larger vacuum intake head. A user can simply detach one of the vacuum intake heads and attach the desired replacement vacuum intake head when performing a cleaning operation. Furthermore, some of the vacuum intake heads may be better adapted for cleaning certain surfaces, such as carpet, while others may be adapted for cleaning wooden or tiled flooring. A user can interchange the vacuum intake head when carrying out the cleaning operation, without having to completely swap out the accessory.

Preferably, the accessory further comprising an elongate body, the vacuum intake head being moveably connected to the elongate body.

Ideally, the vacuum intake head being moveably connected to the elongate body such that the leading edge/portion of the vacuum intake head lifts upwards from the surface to be cleaned during a forward sweeping movement. Advantageously, the moveable connection creates a vertical clearance between the surface to be cleaned and the leading edge/portion of the vacuum intake head as the accessory is swept forwards. This means that larger objects such as stones and crumbs are not pushed forwards by the leading edge/portion of the vacuum intake head, but rather the vacuum intake head moves over the objects and can suck them up via the air intake slot.

Ideally, the vacuum intake head being moveably connected to the elongate body such that the leading edge/portion of the vacuum intake head lowers onto the surface to be cleaned during a backwards sweeping movement.

Preferably, the vacuum intake head being pivotally connected to the elongate body.

Ideally, the vacuum intake head being adaptable to pivot up/down relative to the elongate body.

Ideally, the vacuum intake head being rotatably connected to the elongate body.

Preferably, the vacuum intake head being adaptable to rotate around the longitudinal axis of the elongate body.

Ideally, the vacuum intake head being adaptable to rotate up to 180° or more preferably up to 360° around the longitudinal axis of the elongate body.

Ideally, the elongate body being an elongate shaft connected to the vacuum intake head.

Preferably, the spraying means being arranged within the elongate body.

Ideally, the filtration means being arranged within the elongate body.

Advantageously, the accessory of the present invention has a compact configuration as components such as the filtration means are arranged within the elongate body.

Ideally, the waste fluid storage means and the work fluid storage means being arranged substantially in-line and along the longitudinal axis of the elongate body. Advantageously, the waste fluid storage means and the work fluid storage means being arranged substantially in-line and along the longitudinal axis of the elongate body minimises the width of the elongate body and helps ensure that it has a compact and streamlined appearance.

Preferably, the waste fluid storage means being arranged vertically below the work fluid storage means in the elongate body.

Ideally, the capacity of the waste fluid storage means being larger than the capacity of the work fluid storage means. Advantageously, this means that the waste fluid storage means can receive all of the liquid sprayed out from the work fluid storage means without overfilling.

Ideally, the accessory further comprising a power source for powering the accessory.

Preferably, the power source being for powering a pumping means of the spraying means and/or a motor for rotating at least one rotatable brush of the vacuum intake head.

Preferably, the power source being a battery and most preferably a rechargeable battery.

Ideally, the battery is removable from the accessory. Advantageously, the battery can be removed from the accessory to be recharged/replaced.

Ideally, the accessory further comprising a handle.

Preferably, the handle comprising a hand gripping portion. Advantageously, the hand gripping portion to enable a user to hold and manipulate the accessory.

Preferably, handle being connectable to the elongate body.

Ideally, handle having an internal conduit connectable to the elongate body at one end and the vacuum cleaner at the other.

Ideally, the handle comprising a control means for controlling the accessory.

Preferably, the control means comprising a control panel positionable in operative proximity to the handle. Advantageously, this enables a user to conventionally control the accessory during use.

Ideally, the accessory comprising a battery being mountable in the handle.

Preferably, the battery is releasably attachable to the handle.

Preferably, the work fluid comprising water.

Ideally, the work fluid further comprising a cleaning agent.

Preferably, the accessory is adaptable to be mounted on a corresponding shaped docking station for charging the battery. The docking station can be mounted on a wall, for example.

Accordingly, the present invention further provides filtration means adaptable to be disposed in an accessory of a vacuum cleaner, the filtration means being adaptable to separate liquid from air such that substantially no liquid returns to the vacuum cleaner.

Ideally, the filtration means being disposed in an accessory for a central vacuum cleaner.

Ideally, the filtration means being disposed in the fluid path between a vacuum intake head of the accessory and the vacuum cleaner.

Preferably, the filtration means comprising a waste fluid storage means having an inlet in fluid communication with a chamber of the vacuum intake head and an outlet in fluid communication with the vacuum cleaner.

In one arrangement, the filtration means being an active filtration means.

Ideally, the active filtration means comprising a powered centrifugal fan.

More preferably, the filtration means being passive filtration means.

Preferably, the passive filtration means comprising a waste fluid storage means having an inlet adaptable to be in fluid communication with the chamber of the vacuum intake head and an outlet adaptable to be in fluid communication with the vacuum cleaner.

Ideally, the outlet of waste fluid storage means is restricted in size to limit the amount of liquid that escapes from the outlet.

Preferably, the outlet of the waste fluid storage means is a slit or slot.

In a first arrangement, the passive filtration means comprising: a waste fluid storage means having an inlet in fluid communication with a vacuum intake head of the accessory and an outlet; a filter in fluid communication with the outlet of the waste fluid storage means; and an outlet conduit extending from the filter and adaptable to be releasably connected to the vacuum cleaner, the filter adaptable to trap waste liquid that has escaped from the outlet of the waste fluid storage means and prevent it entering the outlet conduit.

Ideally in the first arrangement, the passive filtration means comprising a plurality of filters arranged in series between the outlet of the waste fluid storage means and the outlet conduit.

Preferably in the first arrangement, the plurality of filters have different grades of permeability such that filters closer to the outlet of the waste fluid storage means are more permeable than filters closer to the outlet conduit.

Ideally in the first arrangement, the permeability of the plurality of filters decreases consecutively from the outlet of the waste fluid storage means to the outlet conduit.

Most preferably in the first arrangement, the size of the outlet of waste fluid storage means is restricted to limit the amount of fluid that escapes from the waste fluid storage means.

Ideally in the first arrangement, the outlet of the waste fluid storage means is a slit or slot.

Preferably in the first arrangement, the waste fluid storage means comprising a plurality of outlets, the passive filtration means comprising a corresponding number of filters and outlet conduits associated with the plurality of outlets.

Ideally in the first arrangement, the passive filtration means further comprises an inlet conduit extending between the chamber of the vacuum intake head of the accessory and the inlet of the waste fluid storage means.

Preferably in the first arrangement, the waste fluid storage means comprises a plurality of inlets and a corresponding number of inlet conduits extending between the chamber of the vacuum intake head and the inlet of the waste fluid storage means.

In a second arrangement, the passive filtration means comprising a fluid storage means having an inlet in fluid communication with a vacuum intake head of the accessory and an outlet; and an outlet conduit extending from the outlet of the waste fluid storage means and adaptable to be releasably connected to the vacuum cleaner, the outlet conduit having at least one twist or turn arranged such that liquid travelling in the outlet conduit loses kinetic energy due to collisions with the walls of the outlet conduit and returns to the waste fluid storage means.

Ideally in the second arrangement, the passive filtration means further comprises an inlet conduit extending between the chamber of the vacuum intake head of the accessory and the inlet of the waste fluid storage means.

Preferably in the second arrangement, the waste fluid storage means comprises a plurality of inlets and a corresponding number of inlet conduits extending between the chamber of the vacuum intake head of the accessory and the inlet of the waste fluid storage means.

Ideally in the second arrangement, the waste fluid storage means comprises a plurality of outlets and a corresponding number of outlet conduits extending from the outlet of the waste fluid storage means.

Preferably, each of the outlet conduits having at least one twist or turn arranged such that liquid travelling in the outlet conduits loses kinetic energy due to collisions with the walls of the outlet conduits and returns to the waste fluid storage means Preferably, the filtration means further comprising a filter enclosure.

Ideally, the filter is removable from the filter enclosure. Advantageously, this enables the filter to be cleaned/replaced.

Ideally, the filter enclosure comprising a drain or weep hole in fluid communication with the waste fluid storage means. Advantageously, the drain or weep hole enables liquid in the enclosure (i.e. liquid that was trapped by the filters) to return to the waste fluid storage means.

Accordingly, the present invention further provides a vacuum cleaner system comprising:

a vacuum cleaner comprising a vacuum source and at least one pipe extending from the vacuum source to at least one inlet port; and an accessory adaptable to releasably connect to the at least one inlet port of the vacuum cleaner, the accessory comprising: a vacuum intake head having a chamber arranged such that when the accessory is connected to the at least one inlet port, the chamber is in fluid communication with the vacuum cleaner and adaptable to receive air and liquid from and around the surface to be cleaned; and filtration means adaptable to separate the liquid from the air such that substantially no liquid returns to the vacuum cleaner.

Ideally, the surface to be cleaned being the floor or ground which the vacuum intake head is positioned over.

Ideally, the vacuum cleaner being a central vacuum cleaner.

Preferably, the central vacuum cleaner comprising a central vacuum source located at a stationary permanent or semi-permanent location in a building.

Ideally, at least one inlet port being locatable in a wall or flooring or other permanent location in the building structure.

Preferably, the central vacuum cleaner comprising a plurality of inlet ports spaced apart at different locations in the building, each inlet port being in the fluid communication with the central vacuum source.

Ideally, the chamber of the vacuum intake head is adaptable to receive air and contaminated work fluid from and around the surface to be cleaned. Here, "contaminated work fluid" means work fluid laden with dust or dirt particles or other contaminants.

Preferably, the filtration means being passive filtration means.

Ideally, the accessory further comprising spraying means for spraying a work fluid onto a surface to be cleaned.

The skilled man will appreciate that all preferred or optional features of the invention described with reference to only some aspects or embodiments of the invention may be applied to all aspects of the invention.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

The invention will now be described with reference to the accompanying drawings which shows by way of example only one embodiment of an apparatus in accordance with the invention.

The present invention relates to accessories for vacuum cleaners such as portable or central vacuum cleaners. The below discussion will focus on the exemplary embodiment of the accessory being for a central vacuum cleaner. However, as can be appreciated, the accessory described below can be equally used in portable vacuum cleaner systems.

Figure 1:
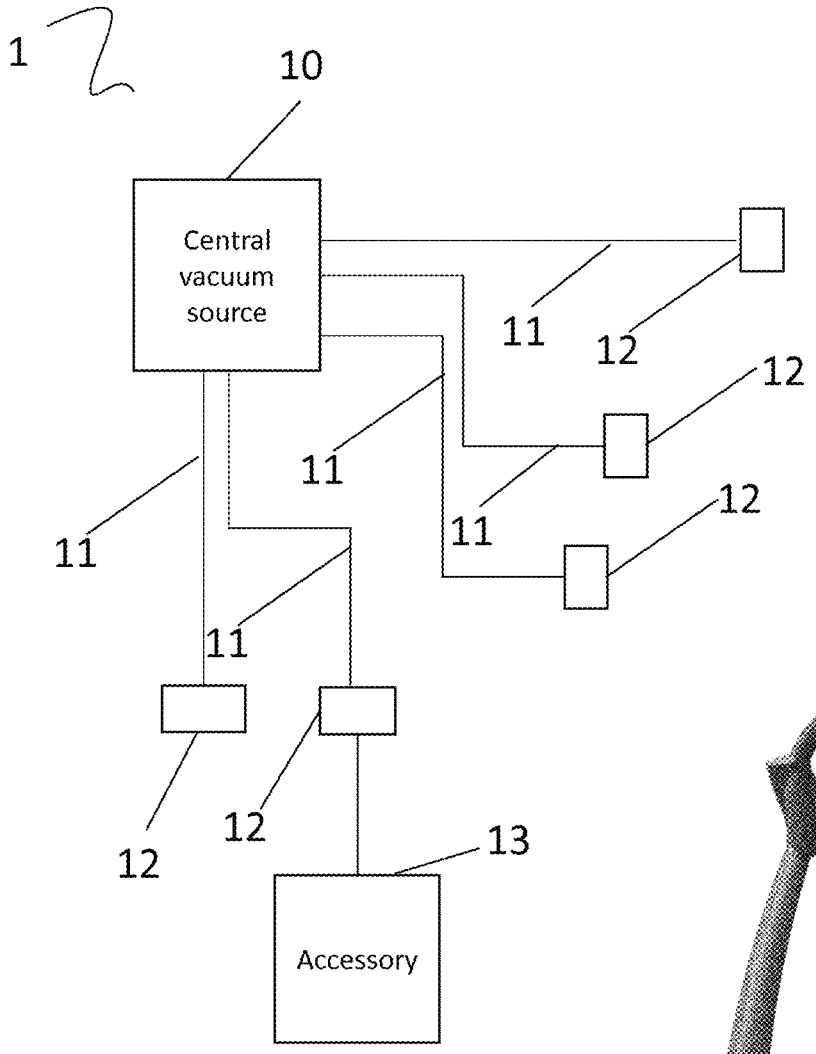
FIG. 1 is a block diagram of a central vacuum cleaner system according to the present invention.

In FIG. 1, there is shown a central vacuum cleaner indicated generally by the reference numeral 1. The central vacuum cleaner 1 comprises a central vacuum source 10 and a number of inlet ports 12 connected to the central vacuum source by a network of pipes 11. It will be appreciated that a central vacuum cleaner 1 differs from a portable vacuum cleaner in that the central vacuum source 10 is installed into a building at a permanent or semi-permanent location (in residential settings this will often be the garage or utility room). The inlet ports 12 are strategically located throughout the building such that in different rooms or areas, a user can connect an accessory 13 to an inlet port 12 to perform a vacuum cleaning. It will be appreciated that the central vacuum cleaner 1 of the present invention is ideally suited for both residential and commercial settings.

Figure 2:
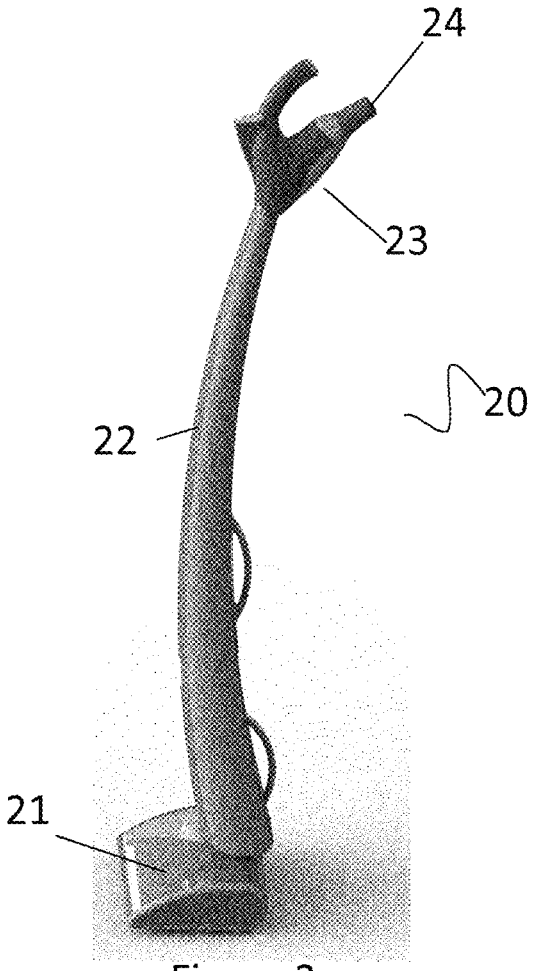
FIG. 2 is a perspective view of an accessory for a central vacuum cleaner according to the present invention.

FIG. 2 provides a general view of an accessory 20 for a central vacuum cleaner 1 according to the present invention. The accessory 20 comprises a vacuum intake head 21 positionable at or about a surface to be cleaned, an elongate body 22, shown as an elongate shaft 22, extending from the vacuum intake head 21, a handle 23 connectable to the elongate body 22 and an outlet 24. The outlet 24 is adaptable to be releasably connected to an inlet port 12 of the central vacuum cleaner 1.

The vacuum intake head 21 (FIGS. 2, 3, 9 and 10) has a chamber 21*a* (FIGS. 4, 9 and 10) arranged such that when the accessory 20 is connected to the central vacuum cleaner 1, the chamber 21*a* is in fluid communication with the central vacuum cleaner 1 and adaptable to receive air and liquid from and around the surface to be cleaned. A filtration device 40 (FIGS. 3-8) is provided for separating the liquid from the air such that substantially no liquid returns to the central vacuum cleaner 1. Advantageously, the accessory 20 can be used to perform both a dry vacuum cleaning and a wet vacuum cleaning operation. In particular, the accessory 20 can operate in a traditional manner to suck dirt, dust and other contaminants from the surface to be cleaned. In addition, the accessory 20 can suck up liquid on the surface to be cleaned, such as soiled liquid which is contaminated with dirt, dust and other contaminants and separate the liquid from the air flow such that the liquid does not return to the central vacuum cleaner 1 where it could damage central vacuum cleaner 1. The filtration device 40 is part of the releasably connectable accessory 20, rather than part of the central vacuum cleaner 1 itself. This means that the accessory 20 of the present invention is useable with central vacuum cleaners 1 for wet cleaning operations even if the central vacuum cleaners 1 do not have liquid filtration devices. As a result, the present invention does not require modification to the central vacuum cleaner 1 in order to provide the wet cleaning operation as the wet cleaning and filtering operations are performed by the accessory 20, with the central vacuum cleaner 1 just performing the conventional role of providing a vacuum source.

The filtration device 40 is disposed within the accessory 20 and in the fluid path between the chamber 21*a* of the vacuum intake head 21 and the central vacuum cleaner 1. In some arrangements, the filtration device 40 is an active filtration device 40 such as a centrifugal fan. In most arrangements, however, the filtration device 40 is a passive filtration device 40. Passive filtration devices 40 do not require any power source (other than the vacuum provided by the central vacuum cleaner) to separate the liquid from the air stream, and thus can be incorporated into the accessory 20 without substantially increasing the weight or power consumption of the accessory 20.

Figure 3:
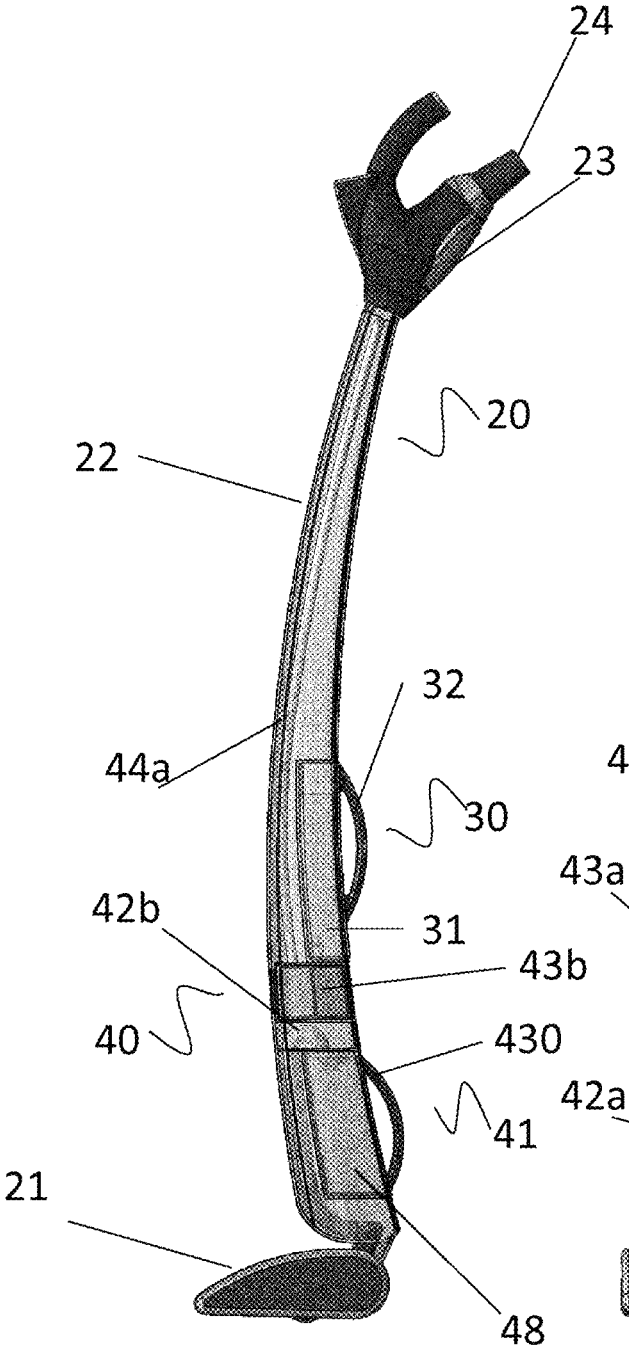
FIG. 3 is a schematic cross section of an accessory for a central vacuum cleaner according to the present invention.
Figure 4:
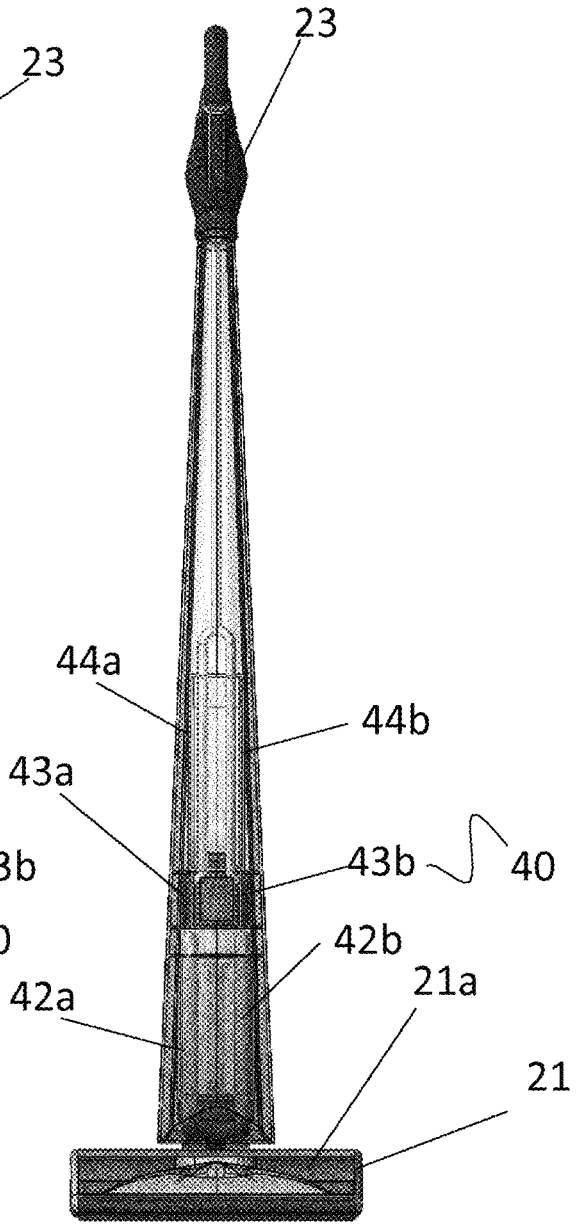
FIG. 4 is another schematic cross section of the accessory in FIG. 3 showing a different view.
Figure 6:
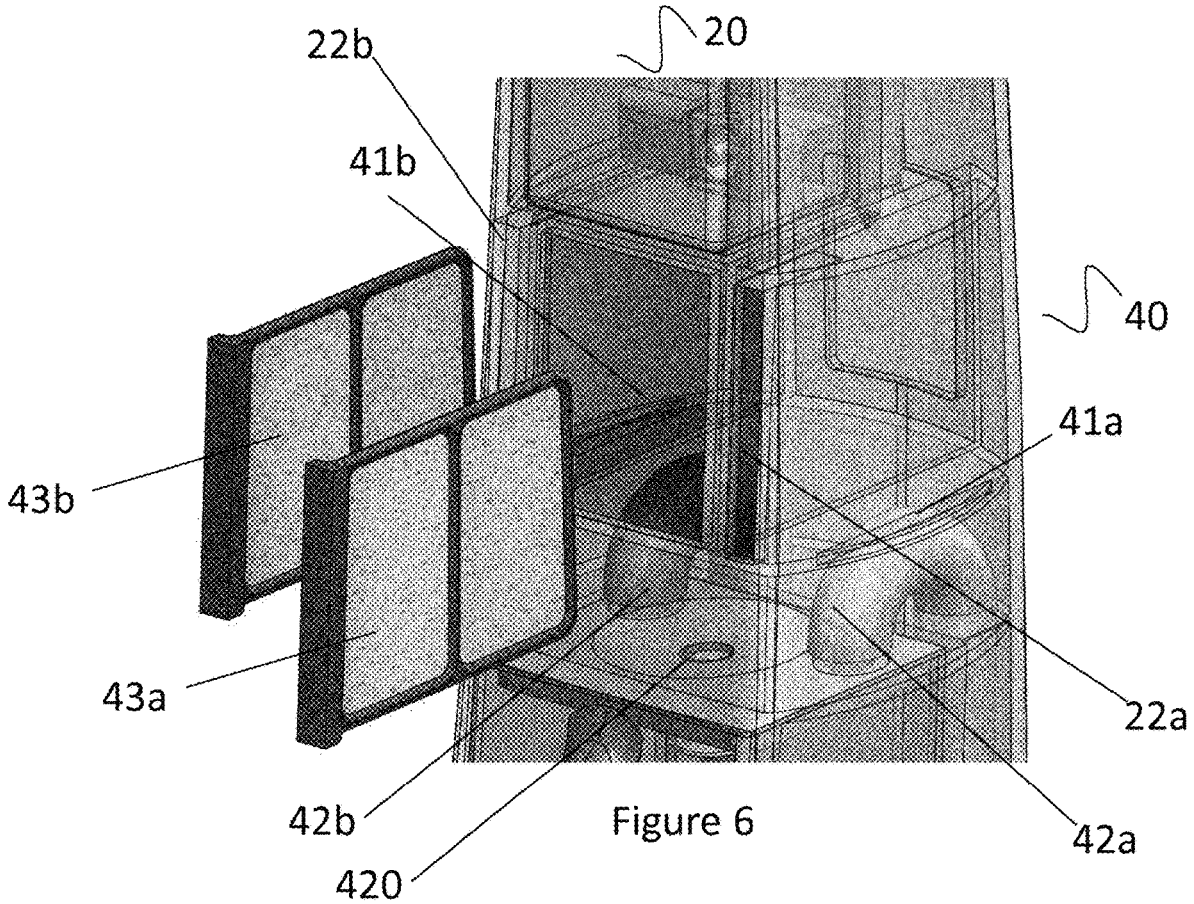
FIG. 6 is another detailed schematic cross section of the passive filtration device according to the first embodiment of the present invention.
Figure 7:
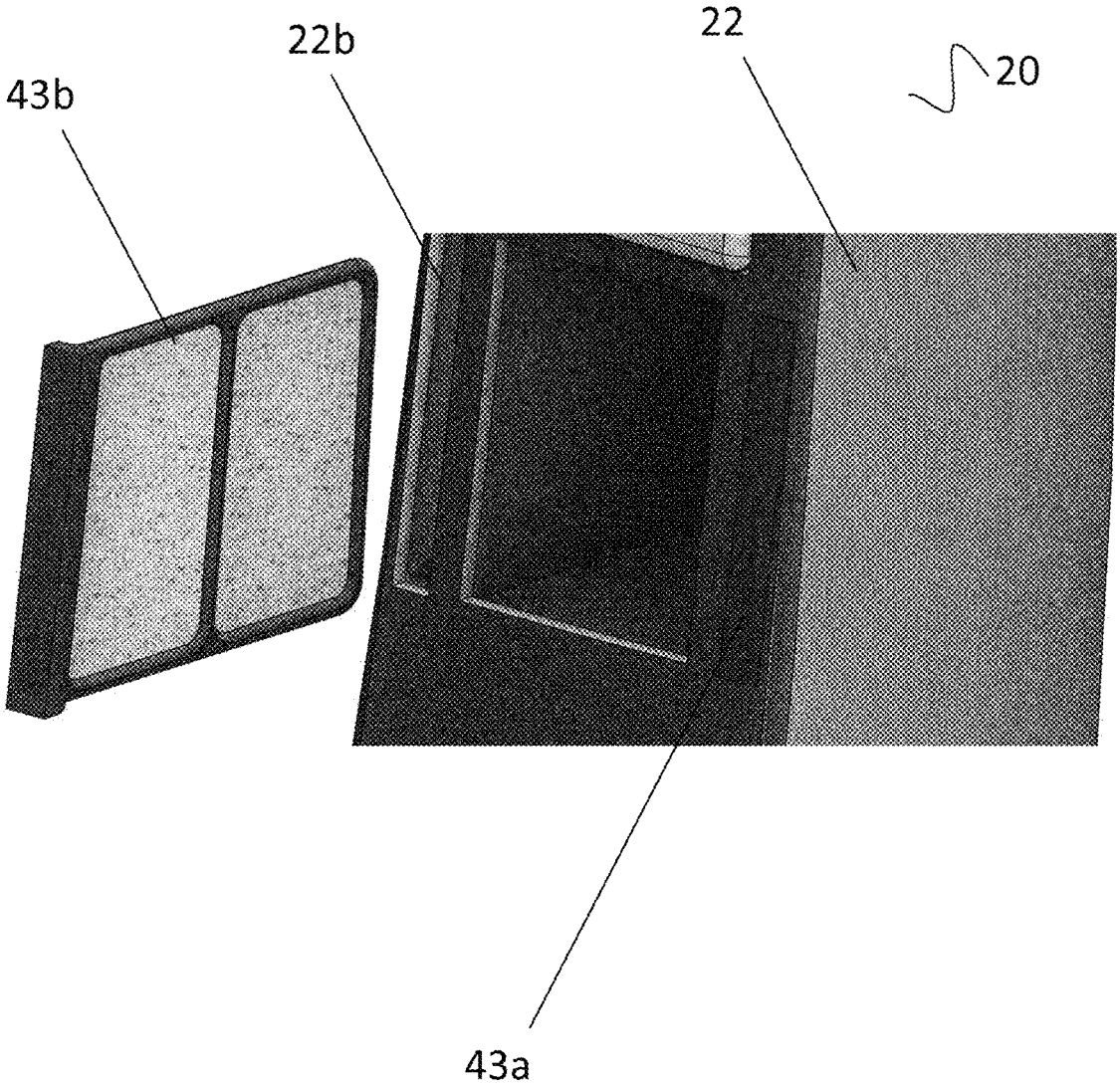
FIG. 7 is a perspective sectional view of the passive filtration device according to the first embodiment of the present invention.

The accessory 20 shown in FIGS. 3 and 4 has a passive filtration device 40 according to a first embodiment of the present invention as discussed in greater detail below in relation to FIGS. 5, 6 and 7. The passive filtration device 40 comprises a waste fluid storage device indicated generally by the reference numeral 41 and having at least one inlet 425 (FIG. 14) in fluid communication with the chamber 21*a* of the vacuum intake head 21. The fluid communication is provided by one or more inlet conduits 42*a*, 42*b* connecting the chamber 21*a* to the at least one inlet 425 of the waste fluid storage device 41. The waste fluid storage device 41 further has at least one outlet 41*a*, 41*b* (FIG. 6). The at least one outlet 41*a*, 41*b* can be restricted in size to limit the amount of liquid that escapes from the at least one outlet 41*a*, 41*b*, while still allowing air to escape to the central vacuum cleaner. In FIGS. 6 and 7, the at least one outlet 41*a*, 41*b* is a slit/slot. The at least one outlet 41*a*, 41*b* is in fluid communication with at least one filter 43*a*, 43*b*. At least one outlet conduit 44*a*, 44*b* extends from behind the at least one filter 43*a*, 43*b* and is adaptable to connect to the central vacuum cleaner 1 via the outlet 24 of the accessory 20. The at least one filter 43*a*, 43*b* is adaptable to trap fluid that has escaped from the at least one outlet 41*a*, 41*b* of the waste fluid storage device 41 and prevent it entering the at least one outlet conduit 44*a*, 44*b*. The trapped fluid can return to the waste fluid storage device 41 under gravity.

Figure 5:
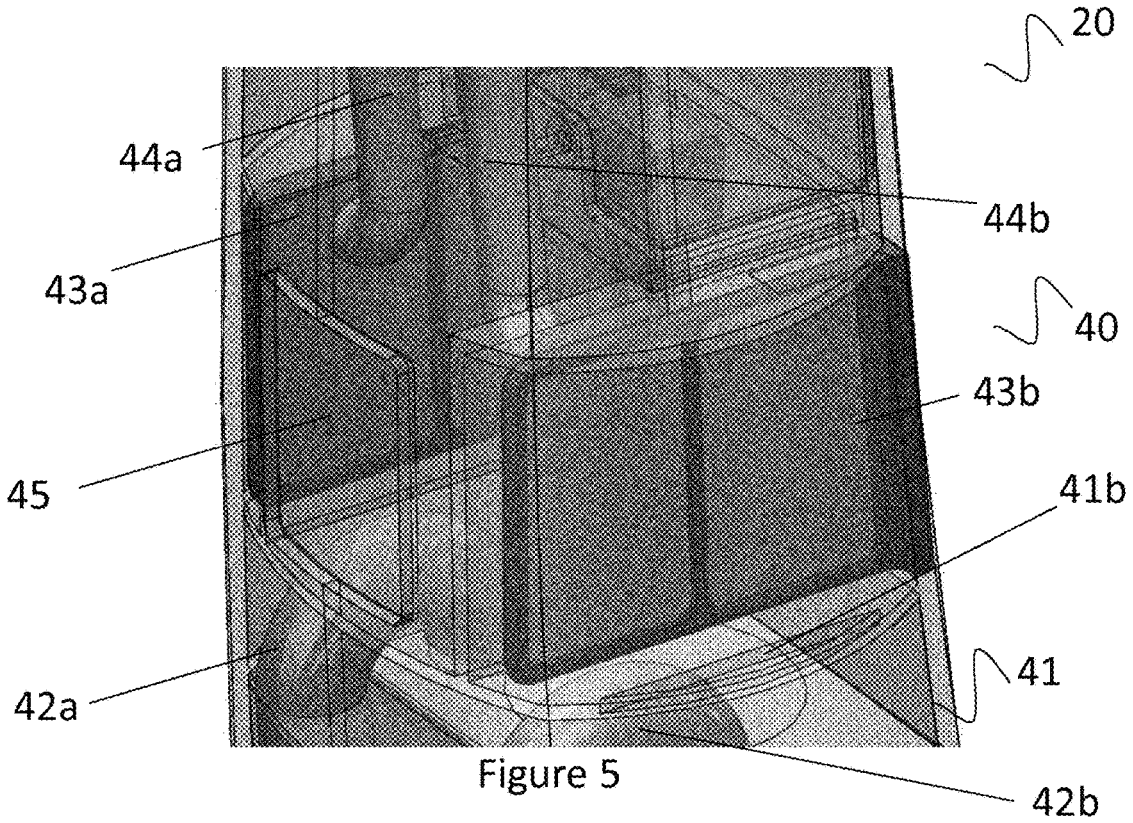
FIG. 5 is a detailed schematic cross section of the passive filtration device according to a first embodiment of the present invention.

FIG. 5 provides further detail of the passive filtration device 40 according to the first embodiment of the present invention. As can be seen in FIG. 5, two filters 43*a*, 43*b* are provided in fluid communication with the outlets 420 of the waste fluid storage device 41. One of the outlets 41*b* of the waste fluid storage device 41 can be seen in fluid communication with one of the filters 43*b*, while the other outlet 41*a* in fluid communication with the other filter 43*a* is behind the filter 43*a* and thus not visible in FIG. 5. Outlet 41*a* of the waste fluid storage device 41 can instead be found in FIG. 6. The two filters 43*a*, 43*b* extend substantially along the width of the elongate body 22 such that the only route for the air stream from the chamber 21*a* of the intake vacuum head 21 to the central vacuum cleaner 1 is through the two filters 43*a*, 43*b*. The outlets 41*a*, 41*b* of the waste fluid storage device 41 are restricted in size to limit the amount of fluid that escapes from the waste fluid storage device 41, and in particular are arranged as small slits or slots. This arrangement helps the outlets 41*a*, 41*b* of the waste fluid storage device 41 restrict the water flow from leaving the waste fluid storage device 41, while still allowing air to escape. The filters 43*a*, 43*b* are able to trap any liquid that does manage to exit the waste fluid storage device 41 and prevent it from reaching the central vacuum cleaner 1. It can be appreciated, that more or less filters 43*a* 43*b*, inlets 425, and outlets 41*a*, 41*b* can be provided.

As shown in FIGS. 6 and 7, the filters 43*a*, 43*b* are positioned in a filter enclosure in the accessory 20 having filter shaped slots 22*a*, 22*b*. The filters 43*a*, 43*b* are removable from the filter enclosure so that they can be cleaned/replaced. In addition, the filter enclosure can also comprise a drain or weep hole (not shown) in fluid communication with the waste fluid storage device 41 so that liquid in the enclosure (i.e. liquid that was trapped by the filters 43*a*, 43*b*) can return to the waste fluid storage device 41

In another arrangement not expressly shown in FIGS. 5 to 7, the passive filtration device 40 comprises a plurality of filters 43*a*, 43*b* arranged in series between the outlet 41*a*, 41*b* of the waste fluid storage device 41 and the outlet conduits 44*a*, 44*b*. The plurality of filters 43*a*, 43*b* can have different grades of permeability such that filters 43*a*, 43*b* closer to the outlet 41*a*, 41*b* of the waste fluid storage device 41 are more permeable than filters 43*a*, 43*b* closer to the outlet conduits 44*a*, 44*b*. In an exemplary arrangement, the permeability of the plurality of filters 43*a*, 43*b* decreases consecutively from the outlet of the waste fluid storage device 41 to the outlet conduits 44*a*, 44*b*.

Figure 8:
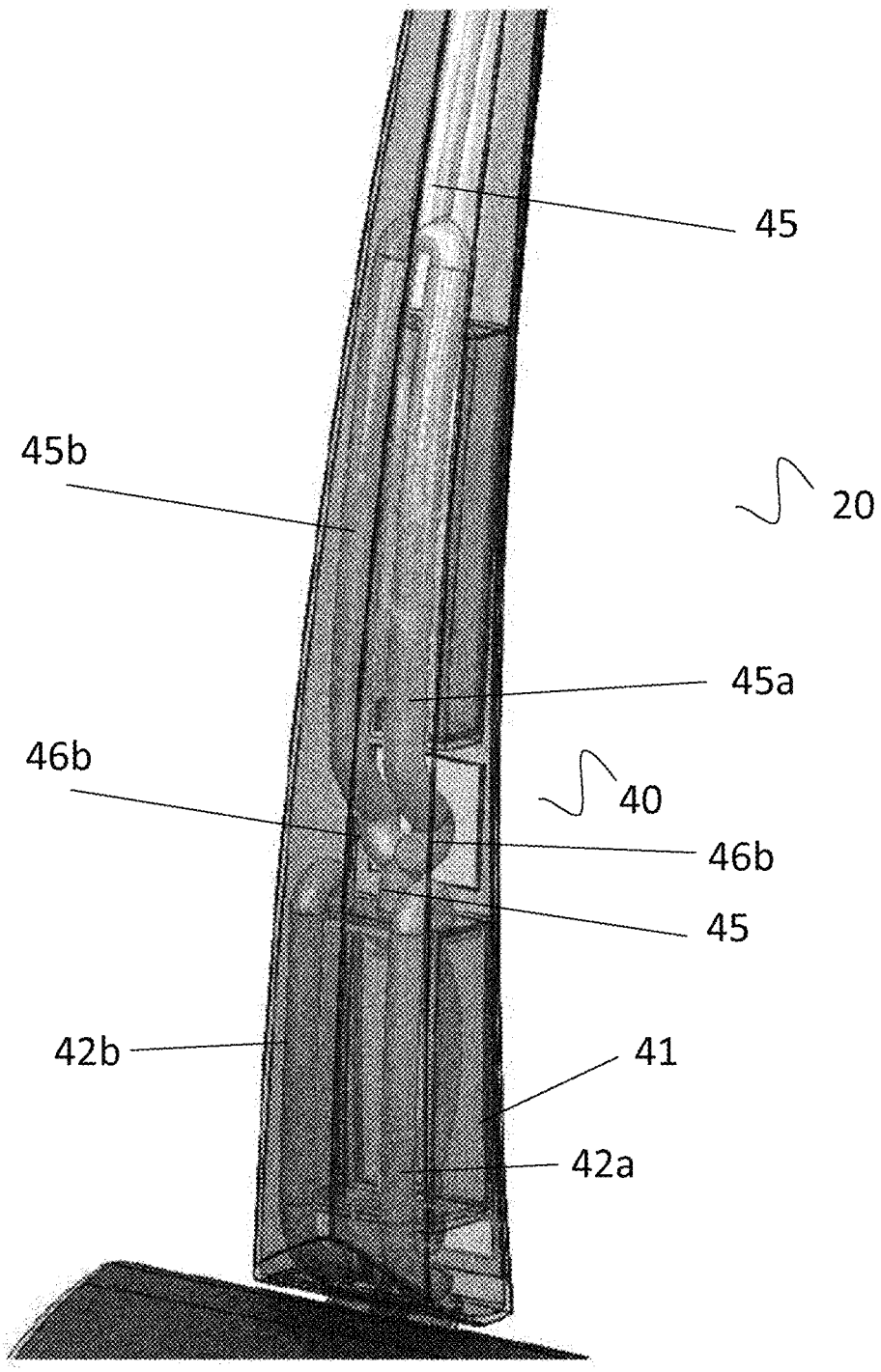
FIG. 8 is a detailed schematic cross section of the passive filtration device according to a second embodiment of the present invention.
Figure 14:
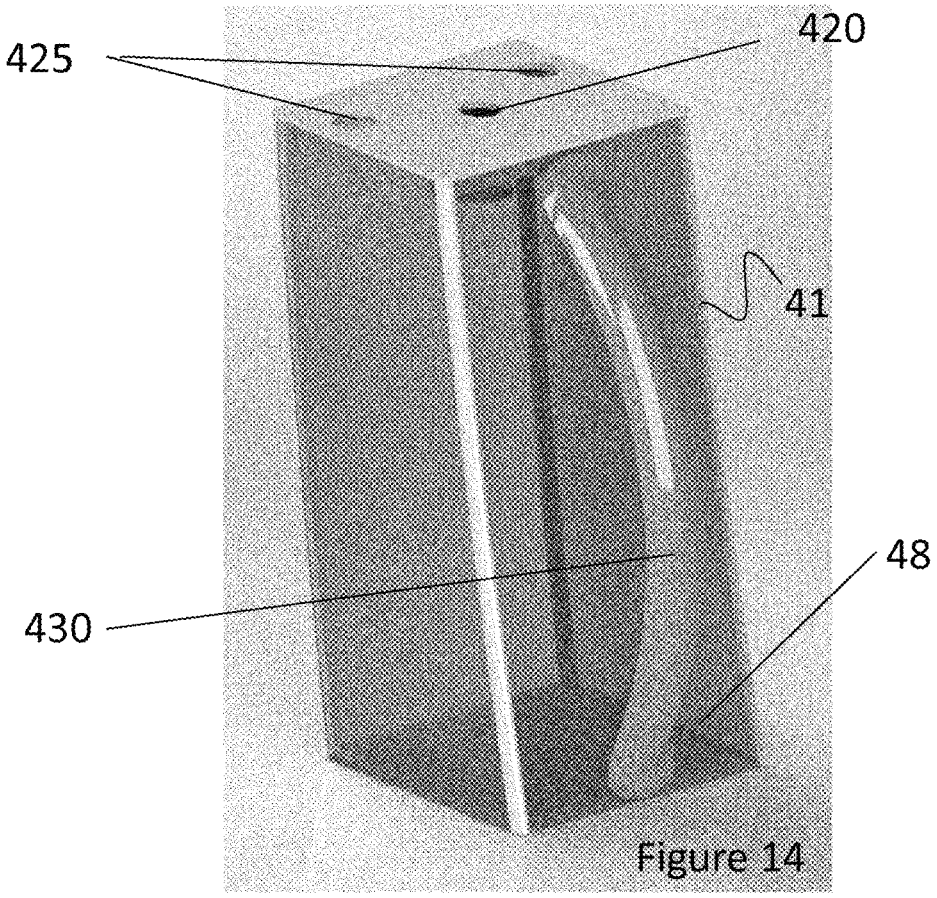
FIG. 14 is a perspective view of the waste fluid storage device according to the present invention.

FIG. 8 provides further detail of a passive filtration device 40 according to a second embodiment of the present invention. The passive filtration device 40 comprises a waste fluid storage device 41 having an inlet 425 (FIG. 14) in fluid communication with the chamber 21*a* of the vacuum intake head 21. The fluid communication is provided by one or more inlet conduits 42*a*, 42*b* connecting the chamber 21*a* to the waste fluid storage device 41. The waste fluid storage device 41 further comprises an outlet 420 (FIG. 14). An outlet conduit 45 is connected to the outlet 420 of the waste fluid storage device 41, and is further releasably connected to the central vacuum cleaner 1 via the outlet 24 of the accessory 20. The outlet conduit 45 has at least one twist or turn 46*a*, 46*b* in it such that fluid travelling in the outlet conduit 45 loses kinetic energy due to collisions with the walls of the outlet conduit 45 and returns to the waste fluid storage device 41 under the force of gravity. In the particular arrangement shown in FIG. 8, the outlet conduit 45 bifurcates into two outlet conduit sections 45*a*, 45*b* each having a twisted section 46*a*, 46*b*. The two outlet conduit sections 45*a*, 45*b* re-join upstream of the twisted sections 46*a*, 46*b* to form a single outlet conduit 45. In other expected arrangements not shown in the figures, the waste fluid storage device 41 could comprise a plurality of outlets, with a corresponding number of outlet conduits 45 extending therefrom. Each of the outlet conduits 45 could have at least one twist or turn in it such that fluid travelling in the outlet conduit 45 loses kinetic energy due to collisions with the walls of the outlet conduit 45 and returns to the waste fluid storage device 41.

While during normal use the filtration devices 40 outlined above will prevent liquid from entering the central vacuum cleaner 1, there is a risk that if/when the elongate body 22 (FIG. 2) of the accessory 20 is dropped or laid on the floor by a user, an excess of liquid may flow out of the at least one outlet 41*a*, 41*b* of the waste fluid storage device 41, overloading the filtration device 40. To this end, the accessory 20 can further comprise a cut-off valve indicated generally by the reference numeral 51 in FIGS. 15 to 20 to cut-off the fluid communication between the waste fluid storage device 41 and the central vacuum cleaner 1 when this situation arises. The cut-off valve 51 is disposed within the elongate body 22 of the accessory 20 and located within the fluid path 50 between the waste fluid storage device 41 and the central vacuum cleaner 1. The filtration device 40 can also be housed in the elongate body 22 of the accessory 20. Fluid communication can be cut-off when the longitudinal axis of the elongate body 22 is substantially aligned with the horizontal so that the cut-off valve 51 can cut-off the fluid communication when the elongate body 22 is dropped or placed on the ground. Any waste fluid that leaks out of the waste fluid storage device 41 in this situation will not return to the central vacuum cleaner 1 as it will be blocked by the cut-off valve 51. In some arrangements, the cut-off valve 51 will cut-off fluid communication in response to the longitudinal axis of the elongate body 22 being over 45° away from the vertical, or more likely over 60° away from the vertical. The cut-off valve 51 will allow fluid communication when the longitudinal axis of the elongate body 22 is less than 45° away from the vertical, or more likely less than 60° away from the vertical.

Figure 15:
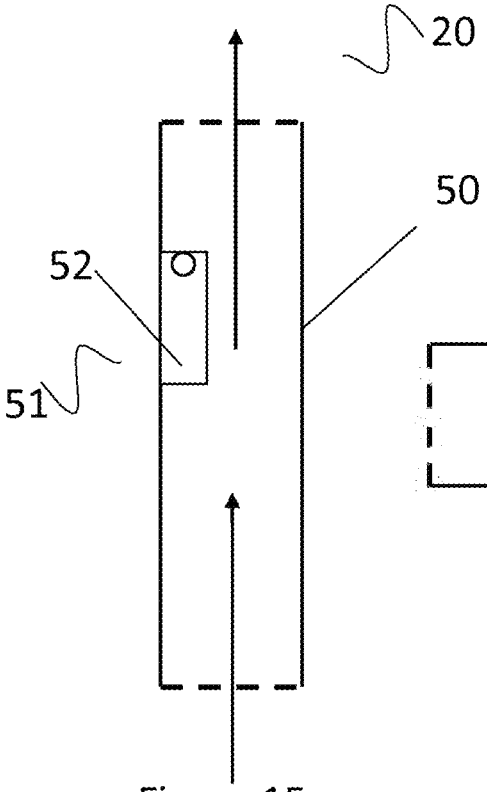
FIG. 15 is a schematic view of a cut-off valve device in an open position according to one arrangement of the present invention.
Figure 16:
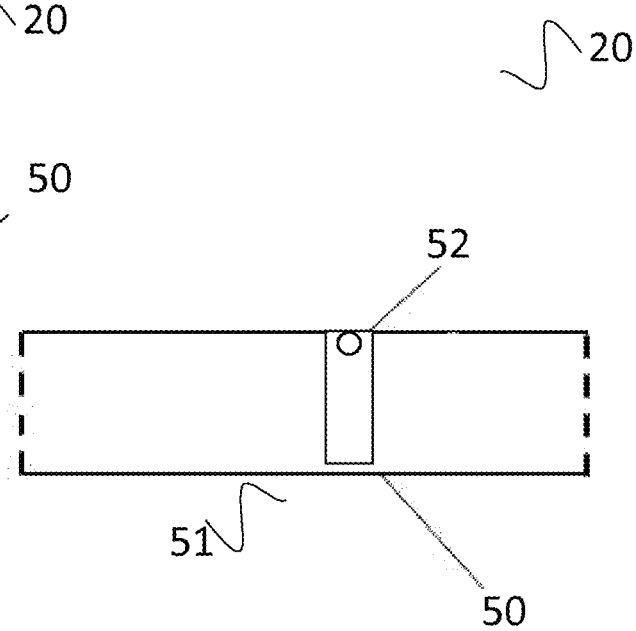
FIG. 16 is a schematic view of a cut-off valve device in a closed position according to one arrangement of the present invention.

FIGS. 15 to 16 detail one arrangement of the cut-off valve 51. In this arrangement, the cut-off valve 51 comprises a flap 52 disposed within the fluid path 50 between the waste fluid storage device 41 and the central vacuum cleaner 1. The flap 52 has an open position shown in FIG. 15 which allows fluid communication between the waste fluid storage device 41 and the central vacuum cleaner 1. The flap 52 transitions to a closed position shown in FIG. 16 which cuts off fluid communication between the waste fluid storage device 41 and the central vacuum cleaner 1. Understandably, the flap 52 is moveable between the open and closed positions. When the longitudinal axis of the elongate body 22 is generally aligned with the vertical, then the flap 52 will lie downwardly under the force of gravity in the open position such that fluid communication is possible. When the longitudinal axis of the elongate body 22 is angled away from the vertical, the flap 52 will remain in its downwardly extending position due to the force of gravity. Once a sufficient angle away from the vertical has been reached by the longitudinal axis of the elongate body 22, then the fluid communication will be blocked, and therefore the flap 52 is in its closed position. The angle required to transition the flap 52 from the open position to the closed position can be selected based on the length of the flap 52. It is generally expected that the flap 52 will be sized to transition to the closed position in response to the longitudinal axis of the elongate body 22 being more than 45°, or more likely more than 60° away from the vertical. Of course, other angles can be selected.

Figure 17:
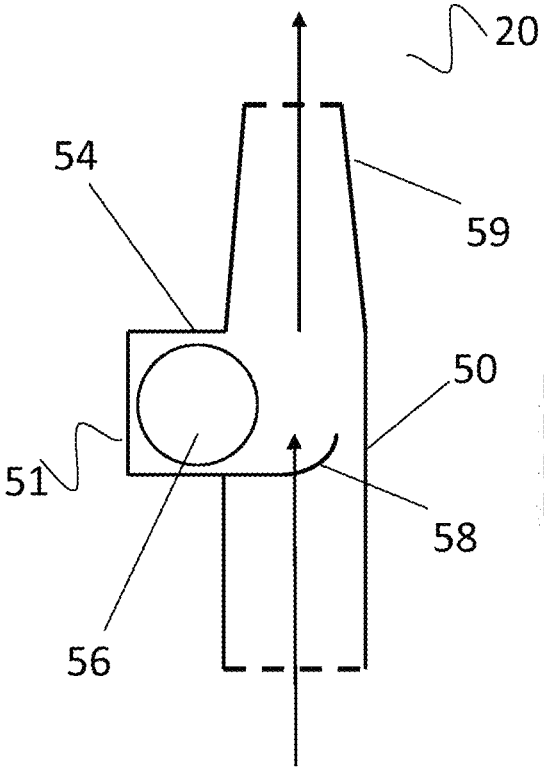
FIG. 17 is a schematic view of a cut-off valve device in an open position according to another arrangement of the present invention.
Figure 18:
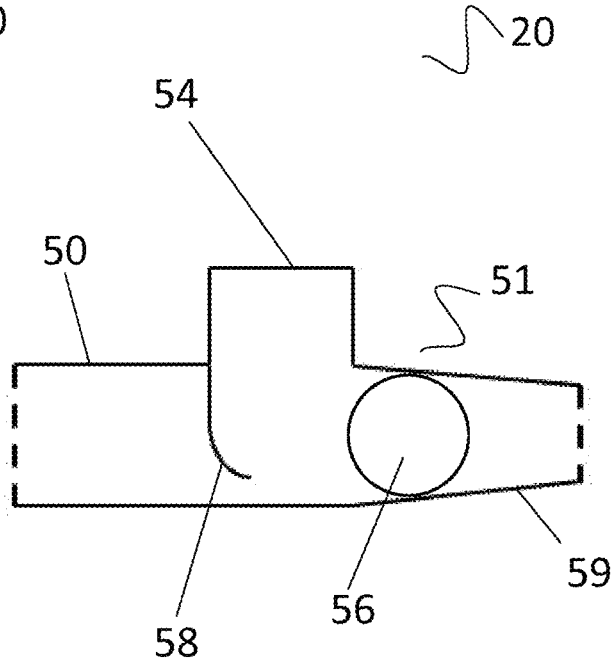
FIG. 18 is a schematic view of a cut-off valve device in a closed position according to another arrangement of the present invention.

FIGS. 17 to 18 detail another preferred arrangement of the cut-off valve device 51. In this arrangement, the cut-off valve device 51 comprises a retaining arrangement 54 disposed within the elongate body 22 and a ball 56 adaptable to be releasably held in the retaining arrangement 54. The ball 56 is sized to have a diameter greater to or substantially equal to the width of at least part of the fluid path 50 between waste fluid storage device 41 and the central vacuum cleaner 1 upstream of the retaining arrangement 54. In this way, when the ball 56 is released from the retaining arrangement 54 it can block the fluid path 50. The retaining arrangement 54 comprises a cage 54 for retaining the ball 56 and a ramp 58 extending into the fluid path 50 between the waste fluid storage device 41 and the central vacuum cleaner 1. The ramp 58 is shaped to prevent the ball 56 from leaving the cage 54 until the longitudinal axis of the elongate body 22 moves beyond a threshold angle away from the vertical. The ramp 58 is further shaped to guide the ball 56 back to the cage 54 when the longitudinal axis of the elongate body 22 returns to an angle less than the threshold angle away from the vertical. The ramp 58 comprises one or more perforations to allow fluid flow through the ramp 58, and thus does not overly affect the fluid communication with the central vacuum cleaner 1.

In this arrangement, the fluid path 50 can comprise a tapered section 59 proximal to an outlet 24 of the accessory 20. The ball 56 is sized to have a diameter greater to or substantially equal to the minimum width of the tapered section 59 such that the ball 56 can block the fluid path 50 when released from the retaining arrangement 54. The threshold angle with which the ball 56 is released from the retaining arrangement 54 to block the fluid path 50 can be selected based on a number of factors, such as the size and shape of the ramp 58 and the cage 54. In most expected arrangements, the retaining arrangement 54 will retain the ball 56 when the longitudinal axis of the elongate body 22 is less than 45°, or more likely less than 60° away from the vertical. Further, the retaining arrangement 54 will release the ball into the fluid path 50 in response to the longitudinal axis of the elongate body 22 being more than 45°, or more likely more than 60° away from the vertical. When the ball 56 is released, it will block the fluid path 50 at a position where the width of the fluid path 50 is substantially equal to or narrower than the width of the ball 56.

Figure 19:
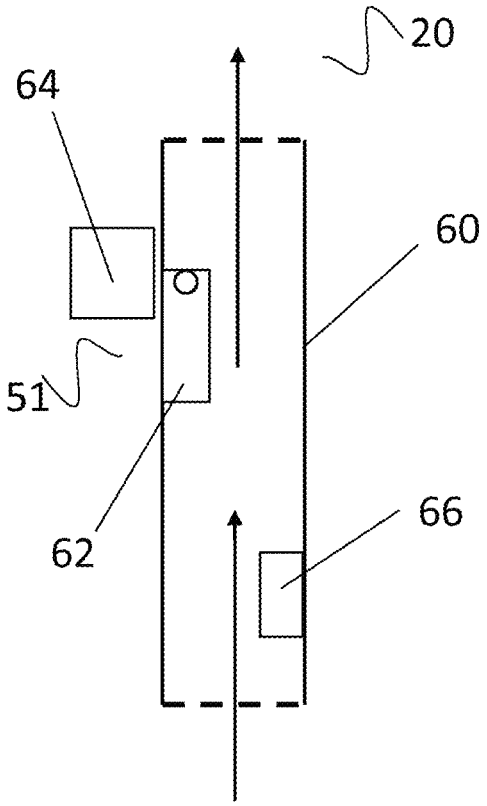
FIG. 19 is a schematic view of cut-off valve device in an open position according to another arrangement of the present invention.
Figure 20:
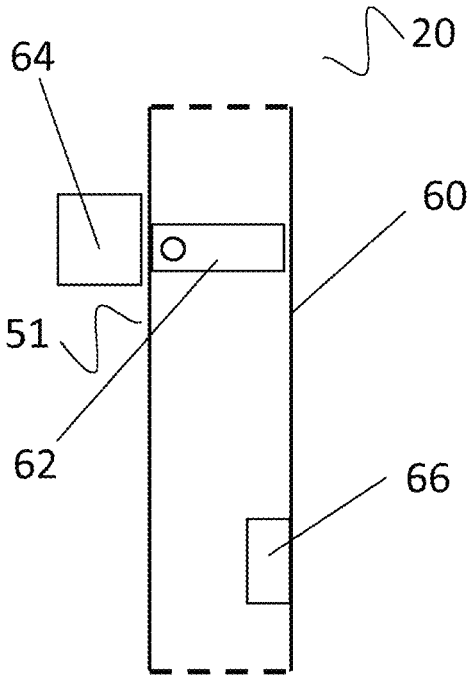
FIG. 20 is a schematic view of a cut-off valve device in a closed position according to another arrangement of the present invention.

FIGS. 19 to 20 detail another arrangement for a cut-off valve 51 which can be used separately or in addition to the cut-off valves 51 presented above. In this arrangement, the cut-off valve 51 is adaptable to cut-off fluid communication between the waste fluid storage device 41 and the central vacuum cleaner 1 in response to liquid escaping from the filtration device 40. Generally, liquid will only escape from the filtration device 40 if there is an excess of liquid present therein, such as when the waste fluid storage device 41 is leaking. The cut-off valve 51 of this arrangement comprises a sensor 66 for detecting liquid escaping from the filtration device 40. A flap 62 is provided in the fluid path 50, and is moveable between an open position as shown in FIG. 19 and a closed position as shown in FIG. 20. As in the previous arrangements, the closed position cuts off fluid communication between the filtration device 40 and the central vacuum cleaner 1. The flap 62 is driven by a drive arrangement 64 which moves the flap 62 to the closed position when the sensor 66 detects liquid escaping from the filtration device 40. In most expected arrangements, the sensor 66 will be located upstream of the flap 62.

The waste fluid storage device 41 comprises a waste fluid storage container 48 as shown in FIG. 14. The waste fluid storage container 48 comprises at least one outlet 420 and at least one inlet 425, most likely two inlets 425. The at least one inlet 425 is in fluid communication with the chamber 21*a* of the vacuum intake head 21 and the outlet 420 is in fluid communication with the outlet 41*a*, 41*b* of the waste fluid storage device 41. The outlet 420 is located on an upper portion of the waste fluid storage container 48 so that during normal use, the outlet 420 will remain above the water line in the waste fluid storage container 48. In most arrangements, the outlet 420 will be located on the top surface of the waste fluid storage container 48 as shown in FIG. 14. The waste fluid storage container 48 is releasably attachable to the accessory 20 so that is can be removed from the accessory 20 to be emptied and cleaned, if necessary. The waste fluid storage container 48 can further comprise a carrying handle 430. Alternatively, the waste fluid storage container 48 is integrally formed with the accessory 20/elongate body 22. The elongate body 22 and waste fluid storage container 48 can be manufactured as a one piece/homogeneous unit. In addition, the waste fluid storage container 48 can have a drainage device (not shown) to allow the waste fluid storage container 48 to be emptied, such as into a sink or toilet. The waste fluid storage container 48 can also comprise a push button (not shown) on an outside surface thereof which can be actuated by a user. Actuation of the push button opens the drainage device to allow the waste fluid storage container 48 to be emptied.

In some arrangements, the waste fluid storage container 48 can further comprise a device for closing the outlet 420 of the waste fluid storage container 48 in response to the volume of liquid in the waste fluid storage container 48 exceeding a threshold value. This arrangement therefore seals off the outlet if the waste fluid storage container 48 is overfilled, preventing liquid from escaping from the outlet 420. This situation could arise if a user neglects to empty the waste fluid storage container 48 between cleaning operations. The device for closing is not shown in the figures, but in one arrangement can comprise a ballcock valve adaptable to rise with the liquid level in the waste fluid storage container 48 and block the outlet 420 of the waste fluid storage container 48 once the volume of liquid in the waste fluid storage container 48 exceeds the threshold value. Alternatively, the device for closing can comprise a cage attached to an inside surface of the waste fluid storage container 48 and enclosing the outlet 420. A ball disposed within the cage is adaptable to rise with the liquid level and block the outlet 420 once the volume of liquid in the waste fluid storage container 48 excess a threshold value. Of course other arrangements for closing the outlet 420 are envisioned.

Figure 21:
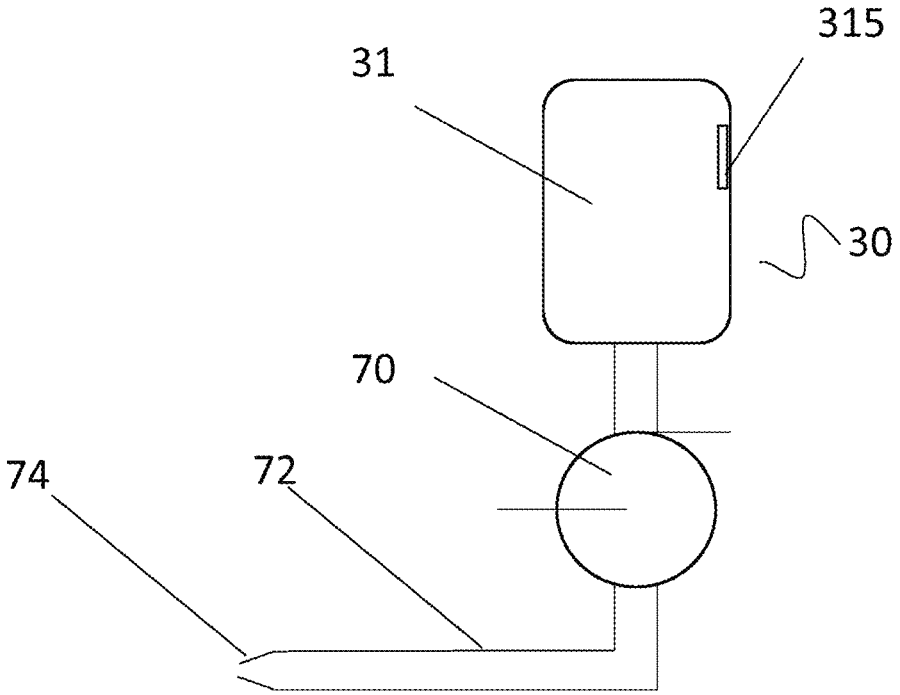
FIG. 21 is a schematic view of a spraying device according to the present invention.

The accessory 20 can further comprise a spraying device indicated generally by the reference numeral 30 (FIGS. 3, 8, 13 and 21) for spraying a work fluid onto the surface to be cleaned. The spraying device 30 is adapted to spray work fluid directly onto the surface to be cleaned. Here a "work fluid" means a fluid that is sprayed onto the surface to be cleaned for cleaning the surface and will typically comprise water and potentially a cleaning agent. It will be appreciated that the specific "work fluid" to be used can be selected as appropriate based on the surface to be cleaned and the type of cleaning required. The spraying device 30 comprises a work fluid storage device 31 and a pumping device 70 (FIG. 21). The pumping device 70 but can be located in the pumping device compartment 45 (FIG. 5). At least one work fluid conduit 72 (FIG. 21) is provided in fluid communication with the work fluid storage device 31. The pumping device 70 is adaptable to pump work fluid from the work fluid storage device 31 and through the at least one work fluid conduit 72. The work fluid conduit 72 terminates in at least one nozzle 74 (FIG. 21). In the arrangement shown in FIGS. 9 and 10, three nozzles 74 are provided. The work fluid conduit 72 is not shown in FIGS. 9 and 10, but it can be appreciated that the work fluid conduit 72 connects the three nozzles 74 to the work fluid storage device 31. The nozzle 74 can concentrate the work fluid into a stream to be sprayed onto the surface to be cleaned. The stream will have a pressure in the range of 25 to 40 PSI, although other pressure ranges are envisioned.

The pumping device 70 can be one of a diaphragm pump, peristaltic pump or vane pump, or any other known device for pumping fluid. Most preferably, however, the pumping device 70 is a compressor, which enables the spraying device 30 to spray boiling or nearly boiling water onto the surface to be cleaned. Boiling water is generally preferred as a work fluid due to its enhanced cleaning properties as compared to cold or tepid water. The arrangement of the accessory 20 adaptable to receive and retain boiling water is discussed in greater detail below.

The pumping device 70 can be adaptable to intermittently spray work fluid onto the surface to be cleaned. To this end, the work fluid storage device 31 comprises a control device (not shown) operable to selectively activate the pumping device 70. In one such arrangement, the control device is a manually operated switch positioned on an external surface of the accessory 20. The switch is operable to trigger the pumping device 70 to spray work fluid onto the surface to be cleaned. In this way, the user can control when work fluid is sprayed onto the surface to be cleaned. In a further such arrangement, the switch is positioned proximal to the handle 23 of the accessory such that it can be easily reached by the user when cleaning. The switch would in this instance generally be a trigger switch.

In another arrangement, the control device is a controller disposed within the accessory 22. The controller is programmable to selectively activate the pumping device 70 to spray work fluid, and selectively activate can involve periodically activating the pumping device 70 to spray work fluid. In one exemplary embodiment, the controller has a first operating mode for periodically activating the pumping device 70 to spray work fluid at a first frequency, and at least one other operating mode for periodically activating the pumping device 70 to spray work fluid at a second frequency different to the first frequency. The operating mode can be chosen, e.g. by a user, based on the surface to be cleaned. For example, the controller may have a "high frequency", "medium frequency" and "low frequency" operating modes which will activate the pumping device 70 at different frequencies. The "high frequency" mode would activate the pumping device 70 at a relatively fast rate making it suitable for cleaning excessively soiled areas but would drain the work fluid storage device 31 of work fluid relatively quickly. The "medium frequency" and "low frequency" operating modes would operate at correspondingly slower rates making them suitable for less soiled areas and drain the work fluid storage device 31 more slowly. A user would be able to select operating mode through use of a control panel 245 (FIGS. 11 and 12) located on an external surface of the handle 23.

Figure 13:
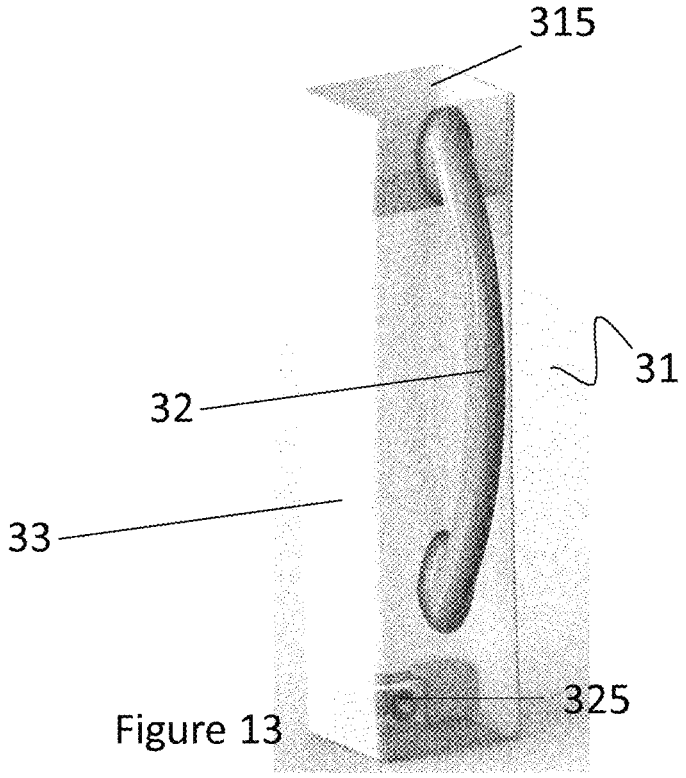
FIG. 13 is a perspective view of the work fluid storage device according to the present invention.

FIG. 13 provides further detail of the work fluid storage device 31. The work fluid storage device 31 comprises an inlet 315, an outlet 325 and a valve provided in the outlet 325 and biased to close the outlet 325. The valve being adaptable to open the outlet when the work fluid storage device is positioned within the accessory 20. In particular, when in use, the work fluid conduit 74 aligns with the outlet 325 of the work fluid storage device 31. When in alignment, the valve is adaptable to open the outlet 325 of the work fluid storage device 31, and therefore work fluid can escape from the outlet 325 and through the work fluid conduit 74. Furthermore, the valve is adaptable to close the outlet 325 when the work fluid conduit 74 is out of alignment with the work fluid storage device 31 and therefore prevent work fluid escaping from the outlet 325.

The inlet 315 can be an accessible inlet 315 for receiving work fluid. In this arrangement, the user is able to fill the work fluid storage device 31 using the accessible inlet 315, such as by using a water jug of kettle. Therefore, it is not necessary for the work fluid storage device 31 to be separated from the accessory 20 to perform the work fluid filling operation. An example of the accessible inlet 315 is shown in FIG. 21, and is located on the outer side surface of the accessory 20. It is generally desirable that the inlet 315 has a device for restricting access to the inlet 315, such as a pivotally moveable flap or lid.

The work fluid storage device 31 comprises a work fluid storage container 33 (FIG. 13) for receiving and storing the work fluid. In one arrangement, the work fluid storage device 31 is adaptable to be releasably attachable to the accessory 20 so that it can be removed from the accessory 20 to be refilled with work fluid and/or cleaned. In this arrangement, the work fluid storage device 31 comprises a carrying handle 32 (FIG. 13) connected to the work fluid storage container 33. In other arrangements, however, the work fluid storage device 31 is not removable from the accessory 20 and is instead formed from the same material or integrally formed with the accessory 20. This arrangement can simplify the construction of the assembly 20 as fewer separable components are required.

In addition, the fixedly attached work fluid storage device 31 can be optimally designed to receive and retain boiling water. In particular, the arrangement where the work fluid storage device 31 is fixedly attached to the accessory 20 and the pumping device 70 is a compressor has been found to be ideally suited for the use of boiling water as the work fluid. One of this reasons for this is that the fixedly attachable work fluid storage device 31 can be optimally designed to receive and retain boiling water, and resist the water pressure within the work fluid storage device 31 caused by a compressor. In this arrangement, the work fluid storage device 31 can further comprise insulation to reduce the spread of heat from the work fluid storage device 31, and therefore maintain the work fluid at its original temperature for longer. The work fluid storage device 31 can further comprise a heating element (not shown) for heating the work fluid. The heating element can heat or help maintain the temperature of the work fluid in the work fluid storage device 31. The heating element can be a resistive heating element, such as a metal heating elements, ceramic heating elements and positive thermal coefficient (PTC) ceramic heating element. It is more likely, however, that the heating element is a thermoelectric heating element.

The capacity of the waste fluid storage device 41 is larger than the capacity of the work fluid storage device 31. This means that the waste fluid storage device 41 can receive all of the liquid sprayed out from the work fluid storage device 31 without overfilling.

The vacuum intake head 21 has a chamber 21*a* (FIGS. 4, 9 and 10) arranged such that when the accessory 20 is connected to the central vacuum cleaner 1 (e.g. by connecting outlet 24 to an inlet port 12), the chamber 21*a* is in fluid communication with the central vacuum cleaner 1 and adaptable to receive air and fluid from and around the surface to be cleaned, such as the floor or ground which the vacuum intake head 21 is positioned over. In other words, the chamber 21*a* receives the vacuum pressure from the central vacuum cleaner 1 and an air stream is established between the chamber 21*a* and the central vacuum cleaner 1 such that matter including dust, dirt and other particles and liquid are sucked up from the surface to be cleaned. The fluid sucked up can be contaminated work fluid where the contaminants are typically dust, dirt and other particles.

Figure 9:
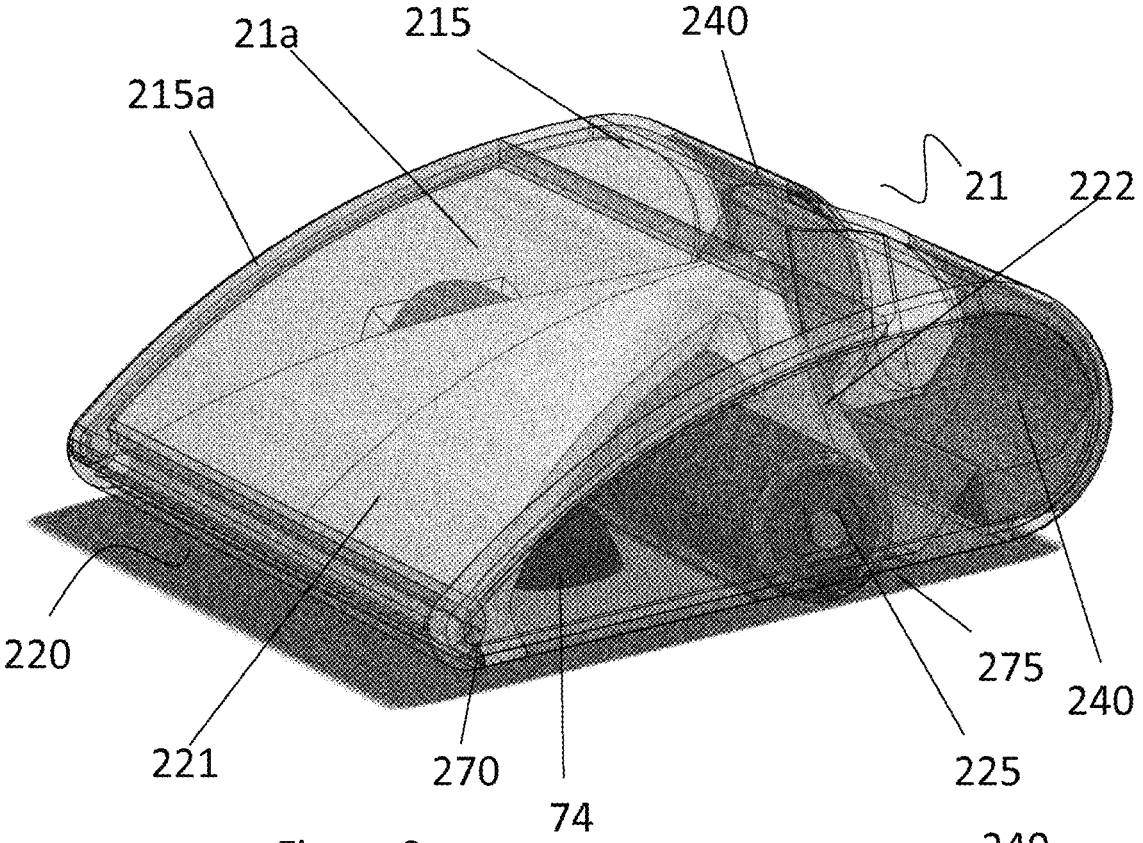
FIG. 9 is a detailed sectional view of a vacuum intake head according to the present invention.
Figure 10:
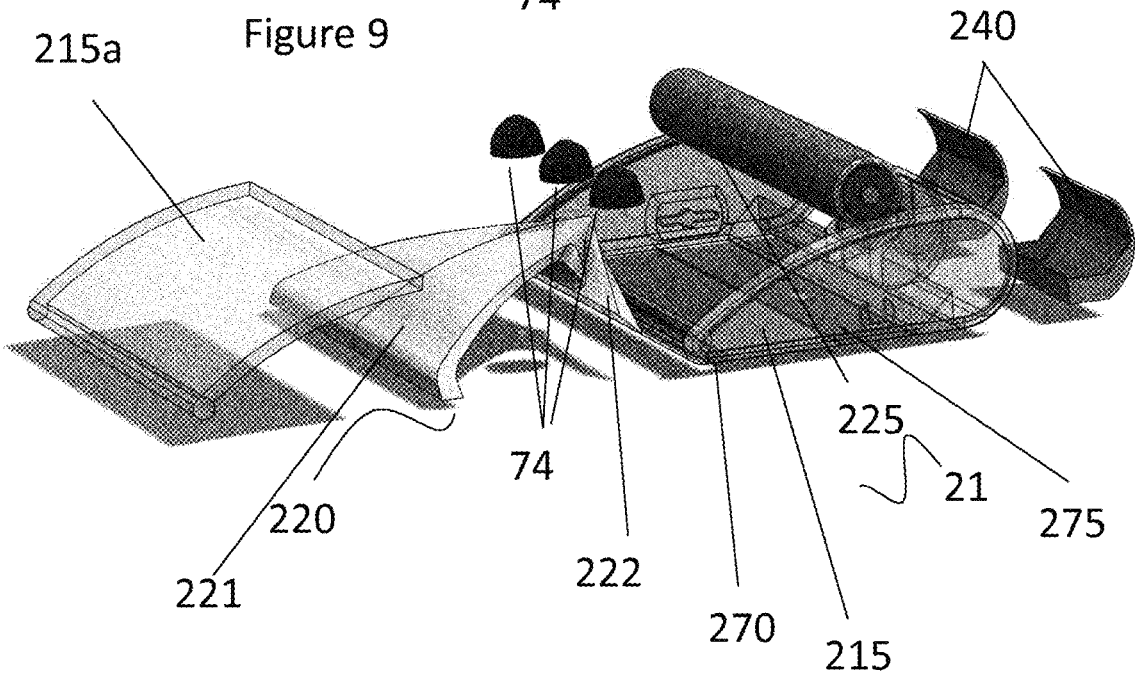
FIG. 10 is an exploded view of the vacuum intake head in FIG. 9.

FIGS. 9 and 10 provide further detail of the vacuum intake head 21. In particular, the vacuum intake head 21 comprises a hollow housing 215 having an air intake slot 270 in fluid communication with the chamber 21*a* and a liquid outlet slot 275 in fluid communication with the spraying device 30. In embodiments where the spraying device 30 is not provided in the accessory 20, it can be appreciated that the liquid outlet slot 275 need not be provided. The spraying device 30 is adaptable to spray work fluid onto the surface to be cleaned through the liquid outlet slot 275. In the arrangement shown in FIGS. 9 and 10, the air intake slot 270 and the liquid outlet slot 275 are disposed in the floor of the housing 215. The air intake slot 270 is positioned towards the leading edge/portion of the housing 215 and the liquid outlet slot 275 being positioned behind the air intake slot 270. In a typical cleaning operation, a user will sweep the vacuum intake head 21 forwards over the surface to be cleaned. The air intake slot 270 is positioned towards the leading edge/portion of the housing 215 and so will come into contact with the surface to be cleaned before the work fluid sprayed out of the work fluid storage device 31. The suction through the air intake slot 270 will act to suck up the loose dust, dirt and debris, but contaminants which are more rigidly adhered to the surface to be cleaned may remain despite the presence of the suction path. Beneficially, the work fluid which is sprayed onto the surface to be cleaned will help to loosen these contaminants. A user can then sweep the vacuum intake head 21 backwards over the surface to be cleaned to suck up the wetted contaminants. Optionally, and as discussed in one or more arrangements later on, the vacuum intake head 21 will have one or more rotatable brushes 225 for agitating the wetted surface to be cleaned to help loosen the contaminants from the surface.

In some arrangements not expressly shown in the figures, the vacuum intake 21 head comprises two air intake slots 270. In such an arrangement, a first of the air intake slots 270 is positioned towards the leading edge/portion of the housing 215 and a second of the air intake slots 270 being positioned towards the rear end portion of the housing 215. The liquid outlet slot 275 is disposed between the air intake slots 270. In this arrangement, the second air intake slot 270 will suck up the contaminants loosened by the work fluid during the forward sweeping operation. Of course, one skilled in the art will appreciate that other arrangements of air intake slots 270 and liquid intake slots 275 are encompassed by this application. For example, there may be more than two air intake slots 270 and more than one liquid outlet slot 275.

The housing 215 further comprises an openable cover 215*a* for enabling an operator to access the components inside the vacuum intake head 21, such as for maintenance. An internal member 220 is positioned within the housing 215 and separates the air intake slot 270 from the liquid outlet slot 275. The internal member 220 is a bifurcated member 220 comprising a first wall section 221 and a second wall section 222, with the chamber 21*a* being defined above the upper surface of the first wall section 221 and the upper surface of the second wall section 222. The first wall section 221 is a generally planar wall extending from a lower front end portion of the vacuum intake head 21 to an upper rear end portion of the vacuum intake head 21. The first wall section 221 tapers from the lower front end portion of the vacuum intake head 21 to the upper rear end portion of the vacuum intake head 21. The first wall section 221 is generally arcuate. The second wall section 22 generally extends from the upper rear end portion of the vacuum intake head 21 to the lower rear end portion of the vacuum intake head 21.

At least one nozzle 74, e.g. three nozzles 74, of the spraying device 30 are provided in the housing 215 in fluid communication with the liquid outlet slot 275. The vacuum intake head 21 further comprises at least one rotatable brush 225 that is adaptable to rotate to agitate the surface to be cleaned, such as the surface to be cleaned where the work fluid has already been applied by the at least one nozzle 74.

The agitation helps to contaminate the work fluid with any dust and dirt particles from the surface to be cleaned which can then be removed from the surface to be cleaned by the suction force generated by the central vacuum cleaner 1. In the arrangement shown in FIGS. 9 and 10, one rotatable brush 225 is provided. It will be appreciated that more than one rotatable brush 225, for example two or three rotatable brushes 225, can be provided as desired.

As shown in FIG. 9, the at least one rotatable brush 225 is disposed over the liquid outlet slot 275 such that a portion of the at least one rotatable brush 225 is able to be in contact with the surface to be cleaned through the liquid outlet slot 275. In other arrangements, the housing 215 comprises two or more liquid outlet slots 275, and the at least one nozzle 74 of the spraying device 31 is adaptable to spray work fluid through one of the liquid outlet slots 275 and the at least one rotatable brush 225 being disposed over another of the liquid outlet slots 275.

The at least one nozzle 74 is adaptable to spray work fluid onto and around the at least one rotatable brush 225. This can be, for example, to perform a bush cleaning operation. Alternatively, the at least one nozzle 74 can spray work fluid onto the surface to be cleaned via the at least one rotatable brush 225. In some arrangements, the at least one nozzle 74 is capable of spraying work fluid onto and around the surface to be cleaned and onto and around the at least one rotatable brush 225. The at least one nozzle 74 can spray work fluid simultaneously onto the surface to be cleaned and the at least one rotatable brush. Typically, the at least one nozzle 74 is adaptable to switch between spraying work fluid onto and around the surface to be cleaned and spraying work fluid onto and around the at least one rotatable brush 225. In this way, a user can switch between a surface/floor cleaning operation and a brush cleaning operation. This switching operation can be performed by a user operating a switch or button on the control panel 245 (see FIGS. 11 and 12).

The at least one rotatable brush 225 can be rotatably connected to the housing. Further, the at least one rotatable brush 225 can be detachable from the housing so that it can be removed from the housing and replaced. The rotatable brush 225 is powered by a motor (not shown), but will generally be located in the vacuum intake head 21. The vacuum intake head 21 can further comprise at least one non-rotatable brush. The at least one rotatable brush 225 and the at least one non-rotatable brush being one of a nylon, polypropylene, horse hair, micro fibre, Tampico or Palmyra brush. The specific brush material can be chosen as appropriate by one skilled in the art based on the desired application of the accessory 20. The at least one non-rotatable brush can be disposed over a liquid outlet slot 275 in a similar manner to the at least one rotatable brush 225. Further, the at least one non-rotatable brush can be detachable from the housing, such as for cleaning, and can be sprayed with work fluid by the at least one nozzle 74. In addition, the vacuum intake head 21 can comprise at least one member 240.

The elongate body 22 of the accessory 20 is releasably connected to the vacuum intake head 21. Therefore, the vacuum intake head 21 can be detached from the elongate body 22 such as for replacement or cleaning. In some arrangements, differently sized vacuum intake heads 21 will be provided for cleaning different areas. A large vacuum intake head 21 will be suitable for cleaning large open areas, while a smaller vacuum intake head 21 will be suitable for cleaning cracks, crevices, remote places or other places that are inaccessible with the larger vacuum intake head. A user can simply detach the current vacuum intake head 21 and attach the desired replacement vacuum intake head 21 when performing a cleaning operation. Furthermore, some of the vacuum intake heads 21 may be better adapted for cleaning certain surfaces, such as carpet, while others may be adapted for cleaning wooden or tiled flooring. A user can interchange the vacuum intake head 21 when carrying out the cleaning operation, without having to completely swap out the accessory 20.

Additionally or alternatively, the accessory 20 is moveably connected to the elongate body 22. In one such arrangement, the vacuum intake head 21 is moveably connected to the elongate body 22 such that the leading edge/portion of the vacuum intake head 21 lifts upwards from the surface to be cleaned during a forward sweeping movement. As the vacuum intake head 21 lifts up, a vertical clearance between the surface to be cleaned and the leading edge/portion of the vacuum intake head 21 is provided. This means that larger objects such as stones and crumbs are not pushed forwards by the leading edge/portion of the vacuum intake head 21, but rather the vacuum intake head 21 moves over the objects and can suck them up via the air intake slot 270. In this arrangement, the vacuum intake head 21 can also be moveably connected to the elongate body 22 such that the leading edge/portion of the vacuum intake head 21 lowers onto the surface to be cleaned during a backwards sweeping movement. The moveable connection can comprise a pivotal connection so that the vacuum intake head 21 can pivot up/down relative to the elongate body 22. Alternatively or additionally, the connection can comprise a rotational connection so that the vacuum intake head 21 can rotate around the longitudinal axis of the elongate body 22. In such arrangements, the vacuum intake head 21 can rotate up to 180° or even up to 360° around the longitudinal axis of the elongate body 22.

The elongate body 22 is generally an elongate shaft 22, and the fluid storage device 31 and waste fluid storage device 41 can be arranged within the elongate body 22 such that they are substantially in-line with one another and positioned along the longitudinal axis of the elongate body 22. This arrangement can be seen in FIGS. 2 and 3 where the work fluid storage device 31 is positioned vertically above the waste fluid storage device 41 within the elongate body 22. This arrangement enables the elongate body 22 to have a compact and streamlined appearance.

Figure 11:
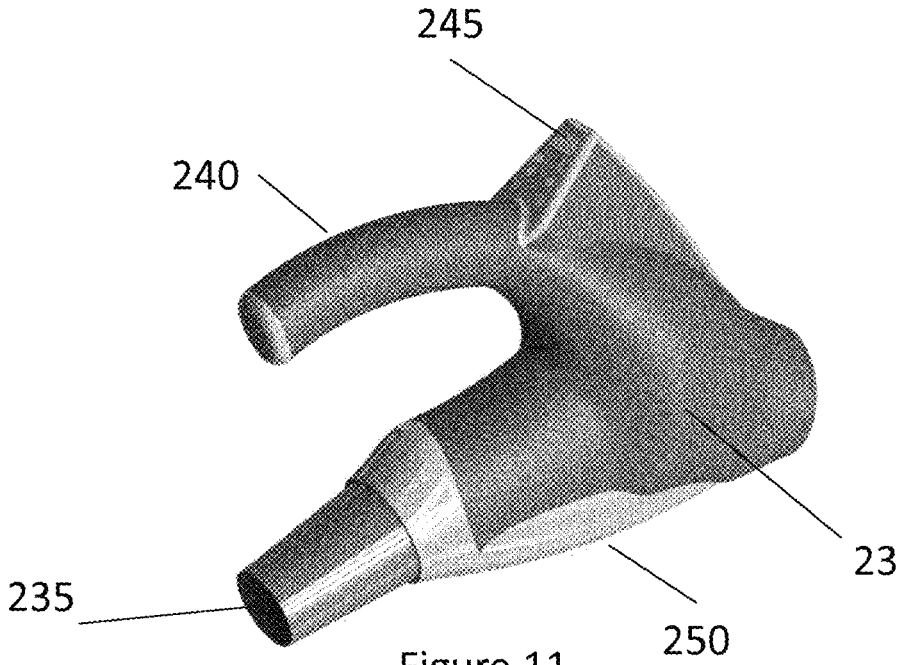
FIG. 11 is a perspective view of the handle for the accessory of the cleaning device according to the present invention.
Figure 12:
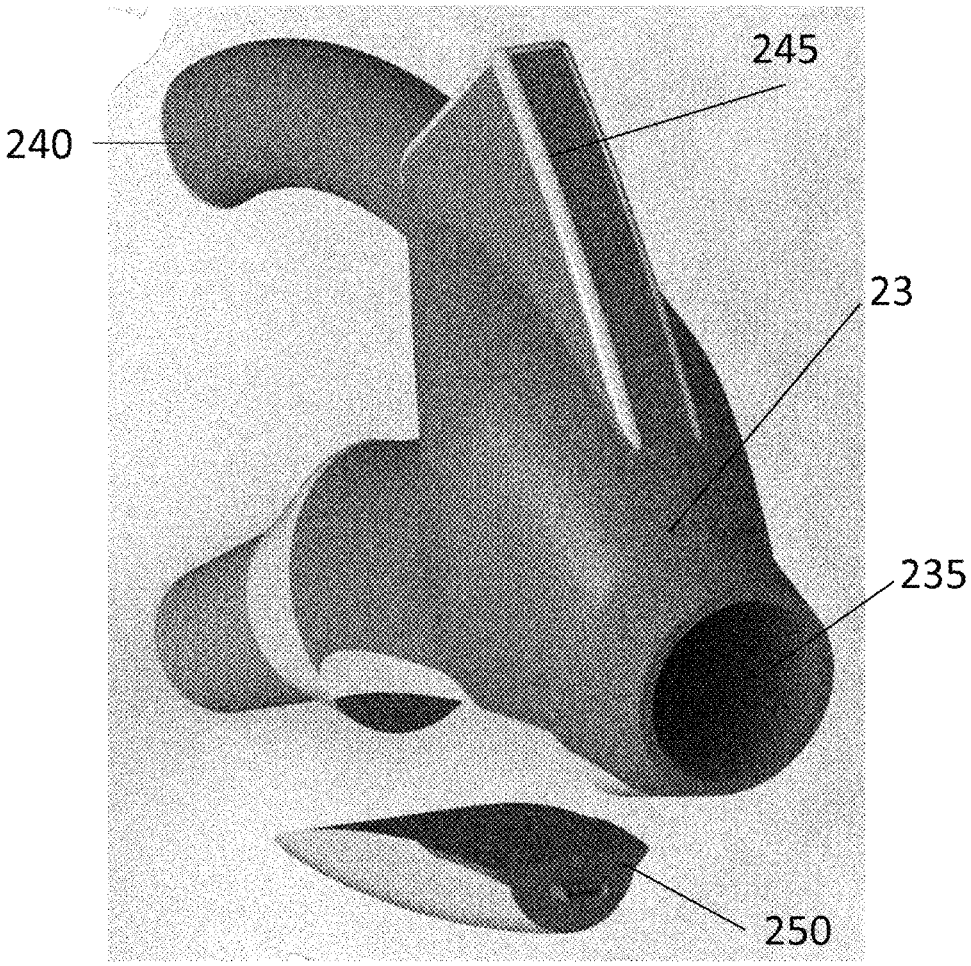
FIG. 12 is another perspective view of the handle for the accessory of the cleaning device according to the present invention.

FIGS. 11 and 12 provide further detail of the handle 23 of the accessory 20. The handle 23 has an internal conduit 235 connectable to the elongate body 22 at one end and an inlet port 12 of the central vacuum cleaner 1 at the other. The handle 23 further comprises a hand gripping portion 240 to enable a user to hold and manipulate the accessory 20. A control panel 245 is provided on the handle 23 in operative proximity to the hand gripping portion 240 such that the user can conveniently control the accessory 20. A battery 250 is releasably connected to the handle 23. The battery 250 is for powering the control panel 245 of the handle 23 and the motor and pumping devices 70 of the accessory 20. In most expected arrangements, the battery 250 will be a rechargeable battery that can be removed from the handle 23 so that it can be charged. The accessory 20 can also be adaptable to be mounted on a corresponding shaped docking station (not shown) for charging the battery 250. The docking station can be mounted on a wall, for example.

According to some implementations of the present invention, the accessory 20 is provided without the spraying device 30. In this arrangement, the filtration device 40 enables the accessory 20 to be used to vacuum up damp surfaces, such as a floor surface where a liquid has been spilled, without damaging the central vacuum cleaner 1.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

The invention claimed is:

1. An accessory for use with a vacuum cleaner, the accessory being adaptable to releasably connect to the vacuum cleaner, comprising:

a vacuum intake head having a chamber arranged such that when an outlet of the accessory is connected to an inlet port of the vacuum cleaner, the chamber is in fluid communication with the vacuum cleaner and adaptable to receive air and liquid from and around the surface to be cleaned;

the vacuum intake head further comprising at least one rotatable brush for agitating the surface to be cleaned;

an elongate body extending upright from the vacuum intake head;

a motor capable of rotating the at least one rotatable brush;

a filtration assembly housed within the elongate body of the accessory and adaptable to separate the liquid from the air such that substantially no liquid returns to the vacuum cleaner; and the filtration assembly comprising a waste fluid storage container having an inlet in fluid communication with the chamber of the vacuum intake and an outlet in fluid communication with the vacuum cleaner;

the waste fluid storage container being releasably attachable to the accessory;

wherein the vacuum intake head is moveably connected to the elongate body, in use.

2. The accessory as claimed in claim 1, wherein the accessory does not comprise a vacuum source.

3. The accessory as claimed in claim 2, wherein the accessory is for use with a central vacuum cleaner and is adaptable to be releasably connected to the central vacuum cleaner.

4. The accessory as claimed in claim 1, wherein the outlet of the waste fluid storage container is restricted in size to limit the amount of liquid that escapes from the outlet.

5. The accessory as claimed in claim 1, wherein the filtration assembly is a passive filtration assembly.

6. The accessory as claimed in claim 1, wherein the waste fluid storage container further comprises at least one filter in fluid communication with the outlet of the waste fluid storage container, and an outlet conduit extending from the at least one filter and being adaptable to be releasably connected to the vacuum cleaner, wherein the at least one filter is adaptable to trap contaminated liquid that has escaped from the outlet of the waste fluid storage container and prevent it entering the outlet conduit.

7. The accessory as claimed in claim 6, wherein the filtration assembly further comprising a filter enclosure, the filter enclosure comprising a drain in fluid communication with the waste fluid storage container.

8. The accessory as claimed in claim 1, wherein the waste fluid storage container comprises an outlet conduit extending from the outlet of the waste fluid storage container and adaptable to be releasably connected to the vacuum cleaner, the outlet conduit having at least one twist or turn arranged such that liquid travelling in the outlet conduit loses kinetic energy due to collisions with the walls of the outlet conduit and returns to the waste fluid storage container.

9. The accessory as claimed in claim 7, further comprising a cut-off valve for cutting-off the fluid communication between the waste fluid storage container and the vacuum cleaner.

10. The accessory as claimed in claim 9, wherein the cut-off valve is disposed within the elongate body of the accessory, wherein the filtration assembly is housed in the elongate body of the accessory, and wherein the cut-off valve is adaptable to cut-off fluid communication between the waste fluid storage container and the vacuum cleaner in response to the longitudinal axis of the elongate body substantially being aligned with the horizontal.

11. The accessory as claimed in claim 10, wherein the cut-off valve comprises a flap disposed within the fluid path between the waste fluid storage container and the vacuum cleaner, wherein the flap is adaptable to transition between an open position allowing fluid communication between the waste fluid storage container and the vacuum cleaner, and a closed position cutting-off fluid communication between the waste fluid storage container and the vacuum cleaner.

12. The accessory as claimed in claim 10, wherein the cut-off valve comprises a ball releasably held within the elongate body, wherein the ball is sized to have a diameter greater to or substantially equal to the width of at least part of the fluid path between the waste fluid storage container and the vacuum cleaner upstream of the cut-off valve.

13. The accessory as claimed in claim 10, wherein the cut-off valve is adaptable to cut-off fluid communication between the waste fluid storage container and the vacuum cleaner in response to liquid escaping from the filtration assembly, and wherein the cut-off valve comprising a sensor for detecting liquid escaping from the passive filtration assembly.

14. The accessory as claimed in claim 1, wherein the waste fluid storage container further comprises a valve for closing the outlet of the waste fluid storage container in response to the volume of liquid in the waste fluid storage container exceeding a threshold value.

15. The accessory as claimed in claim 1, further comprising a sprayer assembly for spraying a work fluid onto a surface to be cleaned.

16. The accessory as claimed in claim 15, wherein the sprayer assembly is adaptable to spray work fluid directly onto the surface to be cleaned.

17. The accessory as claimed in claim 15, wherein the sprayer assembly comprises a work fluid storage container;

a pump; and at least one work fluid conduit in fluid communication with the work fluid storage container, and wherein the pump is adaptable to pump work fluid from the work fluid storage container and through the at least one work fluid conduit.

18. The accessory as claimed in claim 17, wherein the work fluid storage container comprises an inlet, an outlet and a valve biased to close the outlet, wherein the valve is adaptable to open the outlet when the work fluid storage container is positioned within the accessory.

19. The accessory as claimed in claim 17, wherein the work fluid storage container is integrally formed with the accessory.

20. The accessory as claimed in claim 17, wherein the pump is a compressor.

21. The accessory as claimed in claim 20, wherein the pump is adaptable to intermittently spray work fluid onto the surface to be cleaned.

22. The accessory as claimed in claim 21, wherein the work fluid storage container further comprises a heating element for heating the work fluid.

23. The accessory as claimed in claim 15, wherein the vacuum intake head comprises a hollow housing having at least one air intake slot in fluid communication with the chamber and a liquid outlet slot in fluid communication with the sprayer assembly, and wherein the sprayer assembly is adaptable to spray work fluid onto the surface to be cleaned through the liquid outlet slot.

24. The accessory as claimed in claim 23, wherein the at least one air intake slot is positioned towards the leading edge of the housing, and the liquid outlet slot is positioned behind the air intake slot.

25. The accessory as claimed in claim 15, wherein the at least one rotatable brush is disposed over the liquid outlet slot such that a portion of the at least one rotatable brush is adaptable to be in contact with the surface to be cleaned through the liquid outlet slot.

26. The accessory as claimed in claim 25, wherein the sprayer assembly is adaptable to spray work fluid onto and around the at least one rotatable brush.

27. The accessory as claimed in claim 25, wherein the at least one rotatable brush is detachable from the housing.

28. The accessory as claimed in claim 1, wherein the vacuum intake head is releasably connected to the elongate body.

29. The accessory as claimed in claim 1, wherein the vacuum intake head is rotatably connected to the elongate body.

30. The accessory as claimed in claim 1, further comprising a power source for powering the motor.

31. The accessory as claimed in claim 30, wherein the power source is a rechargeable battery.

32. The accessory as claimed in claim 31, wherein the accessory is adaptable to be mounted on a corresponding shaped docking station for charging a battery of the accessory.

33. The accessory as claimed in claim 1, wherein the vacuum intake head is pivotally connected to elongate body.

34. A vacuum cleaner system, comprising:

a vacuum cleaner comprising a vacuum source and at least one pipe extending from the vacuum source to at least one inlet port; and an accessory adaptable to releasably connect to the at least one inlet port of the vacuum cleaner, the accessory comprising: a vacuum intake head having a chamber arranged such that when an outlet of the accessory is connected to an inlet port of the at least one inlet port, the chamber is in fluid communication with the vacuum cleaner and adaptable to receive air and liquid from and around the surface to be cleaned, the vacuum intake head comprising at least one rotatable brush for agitating the surface to be cleaned;

an elongate body extending upright from the vacuum intake head;

a motor capable of rotating the at least one rotatable brush; and a filtration assembly housed within the elongate body of the accessory and adaptable to separate the liquid from the air such that substantially no liquid returns to the vacuum cleaner;

the filtration assembly comprising a waste fluid storage container having an inlet in fluid communication with the chamber of the vacuum intake head and an outlet in fluid communication with the vacuum cleaner;

the waste fluid storage container being releasably attachable to the accessory;

wherein the vacuum intake head is moveably connected to the elongate body, in use.

35. The vacuum cleaner system as claimed in claim 34, wherein the vacuum cleaner is a central vacuum cleaner.

* * * * *